US011035095B2

(12) United States Patent
Huff et al.

(10) Patent No.: US 11,035,095 B2
(45) Date of Patent: Jun. 15, 2021

(54) ELECTRICALLY POWERED MINING VEHICLE

(71) Applicant: Artisan Vehicle Systems Inc., Camarillo, CA (US)

(72) Inventors: Brian R. Huff, Newbury Park, CA (US); Kyle Hickey, Moorpark, CA (US)

(73) Assignee: Artisan Vehicle Systems, Inc., Camarillo, CA (US)

( * ) Notice: Subject to any disclaimer, the term of this patent is extended or adjusted under 35 U.S.C. 154(b) by 283 days.

(21) Appl. No.: 15/980,314

(22) Filed: May 15, 2018

(65) Prior Publication Data

US 2018/0334782 A1 Nov. 22, 2018

Related U.S. Application Data

(63) Continuation-in-part of application No. 29/578,769, filed on Sep. 23, 2016, now abandoned.

(51) Int. Cl.
*E02F 3/64* (2006.01)
*E02F 9/20* (2006.01)
(Continued)

(52) U.S. Cl.
CPC ..... *E02F 3/6418* (2013.01); *E02F 3/3411* (2013.01); *E02F 9/0841* (2013.01);
(Continued)

(58) Field of Classification Search
CPC ..... B60L 50/00; B60L 50/10; B60L 50/40; B60L 50/50; B60L 50/51; B60L 50/52;
(Continued)

(56) References Cited

U.S. PATENT DOCUMENTS 4,397,365 A * 8/1983 Harbe ..... B60K 1/04 180/68.5
4,409,525 A * 10/1983 Hartwig ..... B60L 53/20 318/139

(Continued)

OTHER PUBLICATIONS

Volvo Construction Equipment, L30G, L35G Volvo Compact Wheel Loaders, Mar. 23, 2016, Volvo Construction Equipment, pp. 10-12. Downloaded from: https://www.pacwestmachinery.com/assets/ModelPDFs/Volvo/CompactWheelLoaders/l30g-l35g.pdf (Year: 2016).*

(Continued)

*Primary Examiner* — Saul Rodriguez
*Assistant Examiner* — Brendan P Tighe
(74) *Attorney, Agent, or Firm* — Plumsea Law Group, LLC

(57) ABSTRACT

Various embodiments of a mining vehicle are disclosed. The embodiments provide mining vehicles that are battery powered rather than diesel powered. The embodiments also provide vehicles that have relatively high hauling capacity relative to their length and footprint (area). The embodiments also provide vehicles with improved forward and rearward ground visibility. In addition, the mining vehicles have a higher density compared to traditional vehicles, which helps to improve traction, as well as better vehicle handing and power density because of increased power relative to diesel powered vehicles.

19 Claims, 18 Drawing Sheets

(51) Int. Cl.
*E02F 9/08* (2006.01)
*E02F 3/34* (2006.01)

(52) U.S. Cl.
CPC ..... *E02F 9/207* (2013.01); *E02F 9/2058* (2013.01); *E02F 9/2075* (2013.01)

(58) Field of Classification Search
CPC ..... B60L 50/60; B60L 50/61; B60L 50/70; B60L 50/75; B60L 2200/40; E02F 3/34; E02F 3/3405; E02F 3/3411; E02F 3/6418; E02F 9/0841; E02F 9/2058; E02F 9/207; E02F 9/2075; E02F 9/2091; E02F 9/2095
See application file for complete search history.

(56) References Cited

U.S. PATENT DOCUMENTS 5,120,182 A * 6/1992 Hvolka ..... B60P 1/025 180/418
5,141,384 A * 8/1992 Hvolka ..... B60L 50/60 414/493
5,659,470 A * 8/1997 Goska ..... G07C 5/0858 701/33.4
2006/0061309 A1* 3/2006 Rudinec ..... B60L 1/003 318/139
2008/0099257 A1* 5/2008 Betz ..... B60L 58/10 180/65.245
2009/0033148 A1* 2/2009 Hoff ..... B60L 1/20 307/10.1
2010/0039054 A1* 2/2010 Young ..... B60W 10/26 318/376
2014/0070754 A1* 3/2014 Kouvo ..... E21F 17/06 318/771
2014/0116793 A1* 5/2014 Pelletier ..... B60K 6/26 180/65.225
2015/0071747 A1* 3/2015 Deahl ..... B60L 53/80 414/469
2015/0081150 A1* 3/2015 Wolff ..... B60L 15/007 701/22
2016/0347163 A1* 12/2016 Dorsett ..... B60K 6/30
2018/0037108 A1* 2/2018 Richter ..... H02K 5/173
2018/0334782 A1* 11/2018 Huff ..... E02F 3/3411
2019/0061544 A1* 2/2019 Jansen ..... B60S 5/06
2019/0263270 A1* 8/2019 Huff ..... B60K 1/04
2020/0156500 A1* 5/2020 Huff ..... B60L 58/22
2020/0157769 A1* 5/2020 Huff ..... E02F 9/18

OTHER PUBLICATIONS

Komatsu Mining Corp. Group. Load Haul Dump (LHD) Loaders Product Overview. EN-LHD01-0418-V1. 2018.
Sandvik Mining and Rock Technology. Sandvik LH307 Underground Loader Technical Specification. TS3-LH307-23/ENG/METRIC. 2017.

* cited by examiner

ELECTRICALLY POWERED MINING VEHICLE

CROSS-REFERENCE TO RELATED APPLICATIONS

This application is a continuation-in-part of prior application Ser. No. 29/578,769, filed Sep. 23, 2016, the entirety of which is herein incorporated by reference.

BACKGROUND OF THE INVENTION

The present invention relates generally to mining vehicles.

Various types of mining vehicles may be used to remove and transport material in a mining operation. One type of vehicle, a load-haul-dump machine (LHD) may be used. LHDs may be similar to front-end loaders but with features that facilitate better operation in hard-rock mining applications. Typically, LHDs are rugged and highly maneuverable.

Traditionally, LHDs have been designed to have relatively longer lengths to improve axial weight and bucket capacity. However, the longer length, as well as overall frame geometry of conventional vehicles may limit visibility. Traditional LHDs may also operate with diesel-powered engines that may provide indirect constraints on power and capacity for a machine of a given size and weight.

SUMMARY OF THE INVENTION

Various embodiments of a mining vehicle are disclosed. The embodiments provide mining vehicles that are battery powered rather than diesel powered. The embodiments also provide vehicles that have relatively high hauling capacity relative to their length and footprint (area). The embodiments also provide vehicles with improved forward and rearward ground visibility.

In one aspect, a mining vehicle includes a frame, a set of wheels and a scoop. The mining vehicle also includes a first end and a second end, where the first end is associated with the scoop. The mining vehicle has a first end ground visibility distance associated with the first end of the mining vehicle. The mining vehicle has a hauling capacity, the hauling capacity being a weight of material that can be loaded into the scoop and transported by the mining vehicle, where the hauling capacity is at least 1 metric ton. The first end ground visibility distance is substantially less than 15 meters.

In another aspect, a mining vehicle includes a frame, a set of wheels and a scoop. The mining vehicle includes a first end and a second end, where the first end is associated with the scoop. The mining vehicle has a second end ground visibility distance associated with the second end. The mining vehicle has a hauling capacity, the hauling capacity being a weight of material that can be loaded into the scoop and transported by the mining vehicle, where the hauling capacity is at least 1 metric ton. The second end ground visibility distance is less than 30 meters.

In another aspect, a mining vehicle includes a frame, a set of wheels and a scoop. The mining vehicle further includes a power system including an electric motor, the electric motor having a peak power value. The mining vehicle has an overall length, an overall width and an overall height. The mining vehicle has an envelope volume equal to a product of the overall length, the overall width and the overall height. The mining vehicle has a power density equal to a ratio of the peak power value to the envelope volume and the power density is approximately 6 kilowatts per cubic-meter or greater.

Other systems, methods, features, and advantages of the invention will be, or will become, apparent to one of ordinary skill in the art upon examination of the following figures and detailed description. It is intended that all such additional systems, methods, features, and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The embodiments are directed to a working vehicle with a scoop. The vehicle is electric and uses only a battery to power the vehicle in place of a conventional diesel engine.

The vehicle may be used in mining operations. The vehicle is designed with a substantially smaller form factor compared to conventional vehicles. Because the vehicle is all electric, there is a lot of space saved compared to diesel machines that require an engine, transmission, torque converter, etc. The vehicle has been designed with a small footprint—including a reduction in length as well as a reduction in vertical height, compared to similar diesel vehicles.

In contrast to conventional designs, this vehicle is designed to optimize the ratio of power to size (e.g., maximize the power-to-size ratio given some other constraints). Here the size could refer to either total volume or a combination of one or more linear measurements.

For purposes of clarity the following terms may be used in the detailed description and the specification. The term "hauling capacity," or simply capacity, is used to characterize the amount of material that can be held in the scoop of a vehicle, and that can also be lifted by the scoop and transported. The hauling capacity may also be referred to as the "tramming capacity." As discussed in further detail below, a vehicle may also be characterized by the ratio of its hauling capacity with some other characteristic such as its length, footprint, volume, density, or other characteristic. As an example, some of the following embodiments are characterized by a hauling capacity per unit overall length, which is simply a ratio of the hauling capacity and the overall length of the vehicle. Such a ratio may be understood to provide a constraint on the length of a vehicle for a given hauling capacity (or vice versa). In another case, a ratio of the hauling capacity to a ground visibility distance is given. Such a ratio provides a constraint on the degree of visibility of a driver sitting in the cab of the vehicle.

Figure 1:
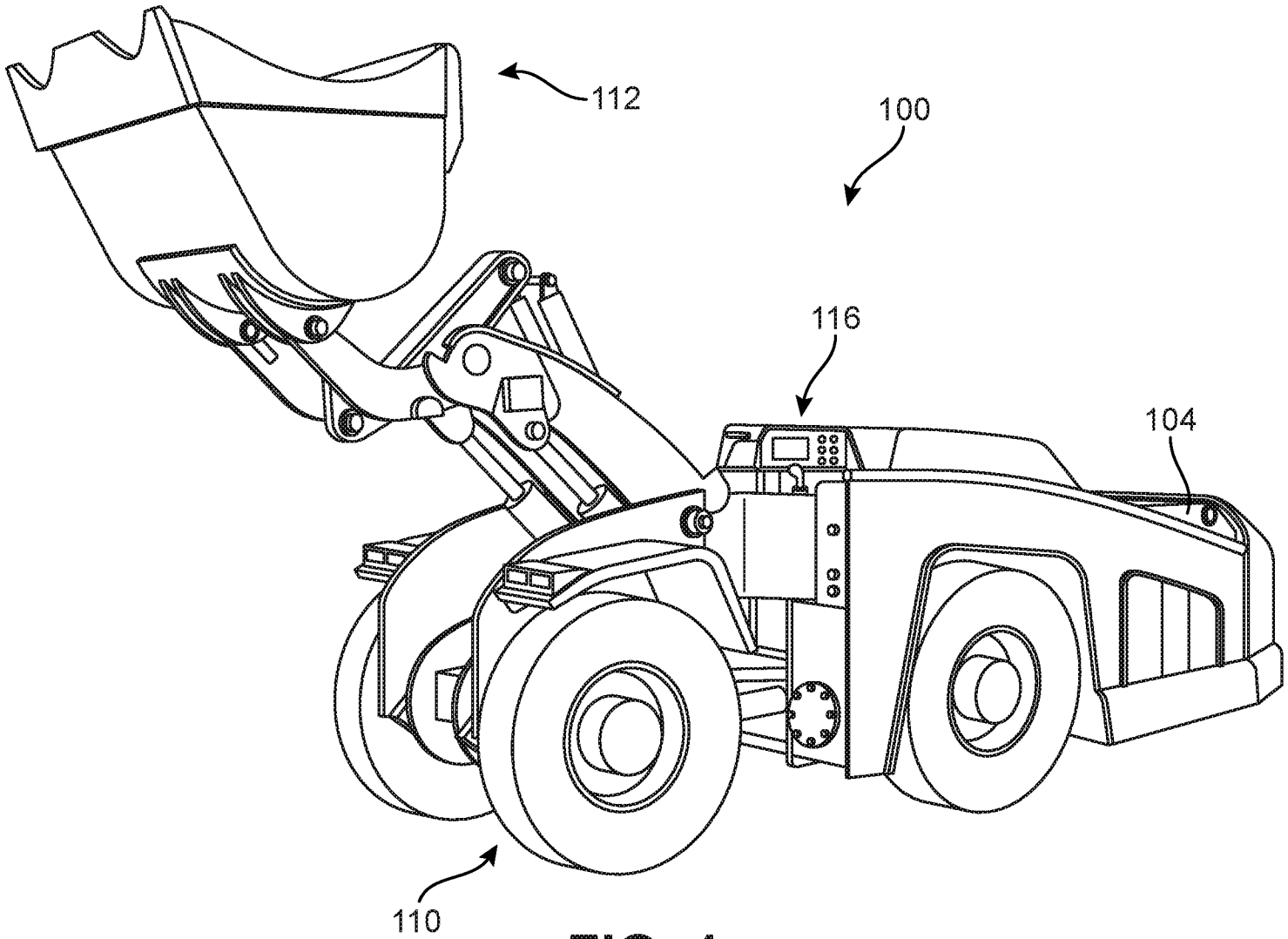
FIG. 1 shows an embodiment of a mining vehicle.
Figure 2:
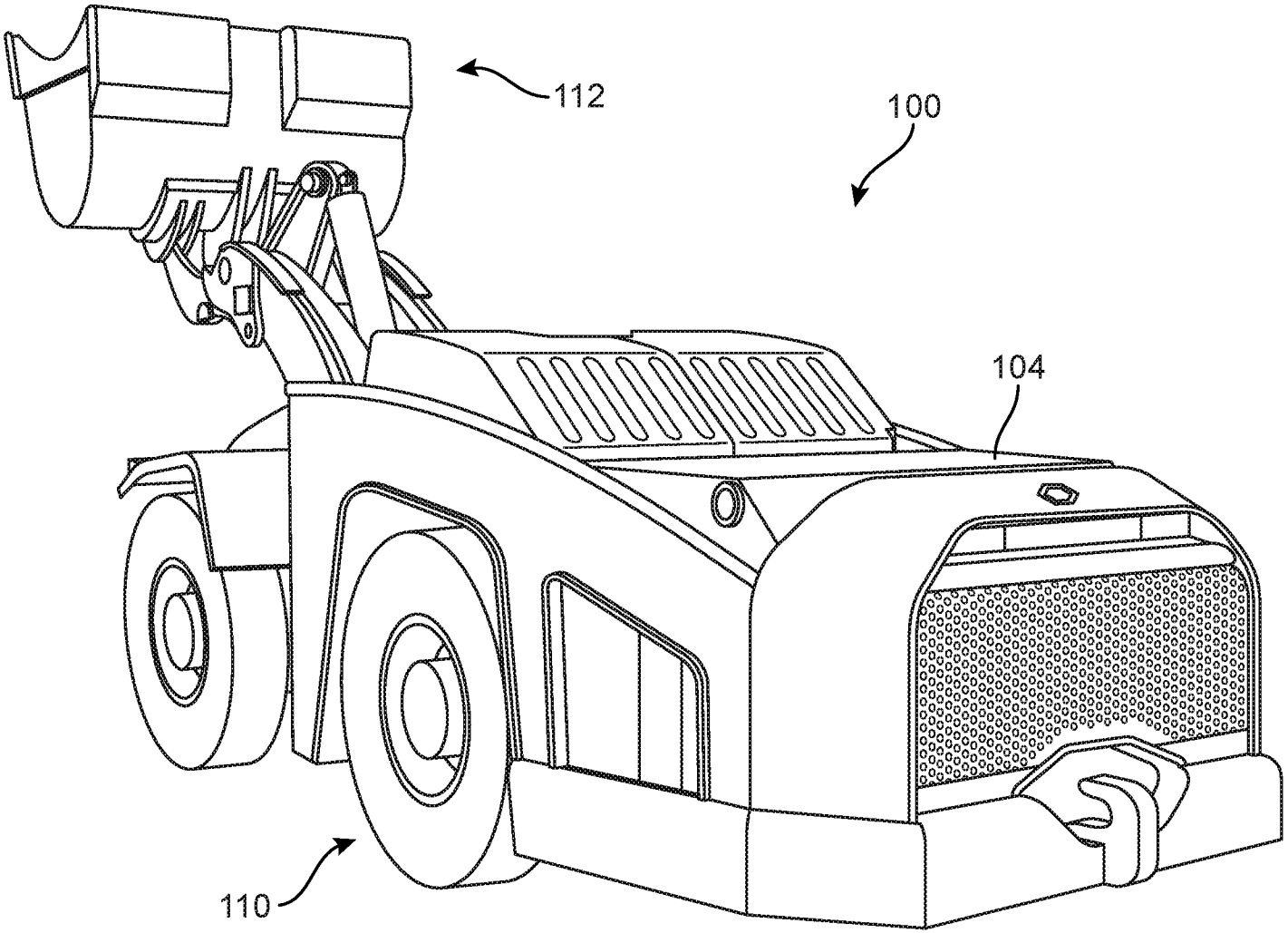
FIG. 2 shows another view of the mining vehicle of FIG. 1.

FIGS. 1 and 2 illustrate schematic isometric views of vehicle 100. Vehicle 100 may include standard provisions for a mining vehicle, such as wheels 110 and scoop 112. Vehicle 100 may also include provisions for powering wheels 110 and scoop 112. Vehicle 100 may include an electric motor (not shown), which is powered by onboard battery 104. In some embodiments, vehicle 100 has an electric motor that operates with a continuous torque of approximately 695 Newton-meters and a peak torque of approximately 400 Newton-meters.

In different embodiments, the hauling capacity of vehicle 100 could vary. In some embodiments, vehicle 100 could have a hauling capacity approximately in the range between 1 and 2 metric tons. In other embodiments, vehicle 100 could have a hauling capacity approximately in the range between 2 and 3 metric tons. In still other embodiments, vehicle 100 could have a hauling capacity approximately in the range between 3 and 4 metric tons. In still other embodiments, vehicle 100 could have a hauling capacity substantially greater than 4 metric tons.

Battery 104 may be removably attached to vehicle 100. Onboard battery 104 may be any type of rechargeable battery suitable for use in a mine vehicle. In some embodiments, battery 104 may be a lithium iron phosphate battery. In some cases, batter 104 may be a 600 Volt DC battery with an energy of 88 kilowatt-hours.

Vehicle 100 is also provided with various standard vehicular mechanisms and capacities, such as passenger cab 116 for receiving one or more operators.

Figure 3:
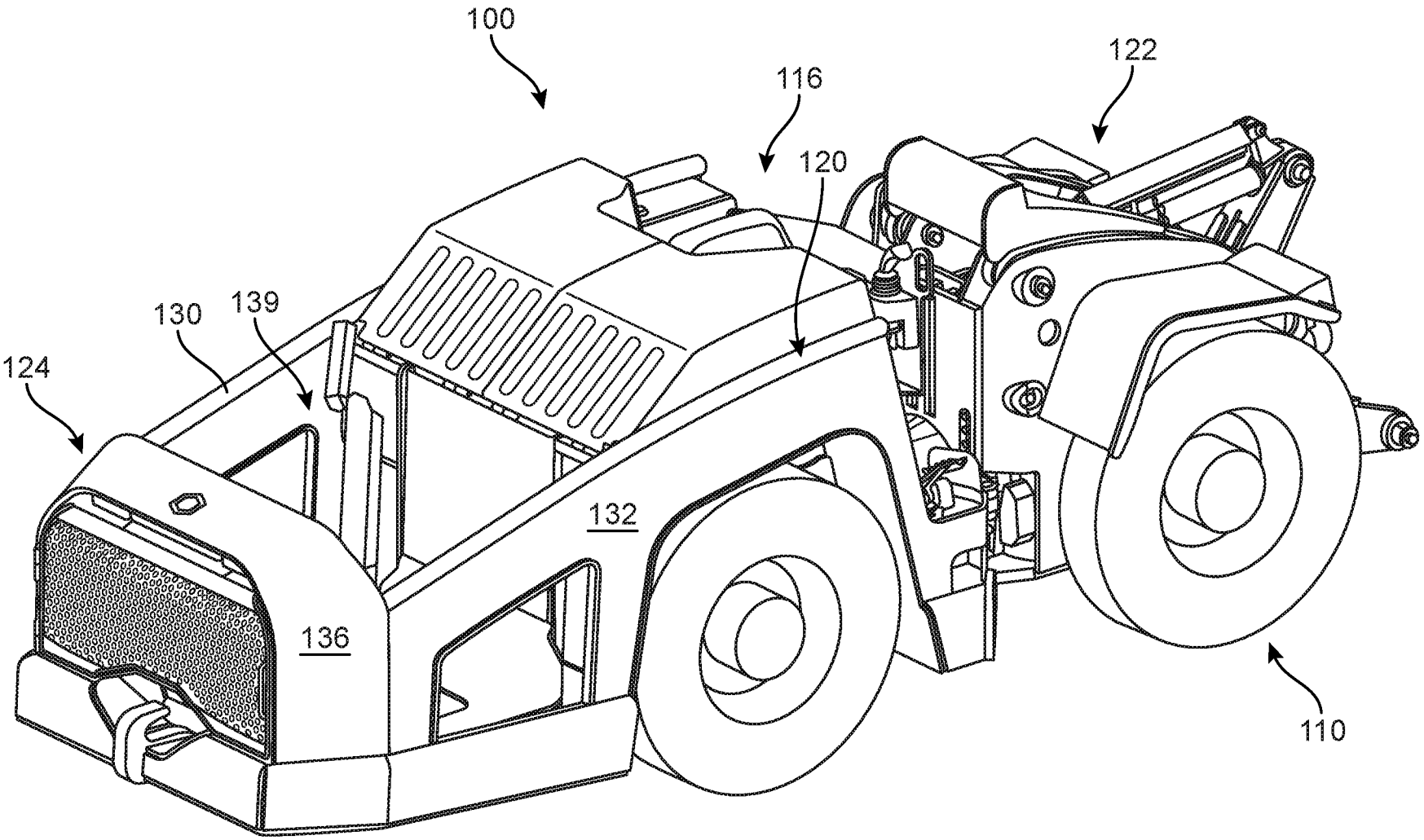
FIG. 3 shows an embodiment of a mining vehicle with some components removed for clarity.
Figure 4:
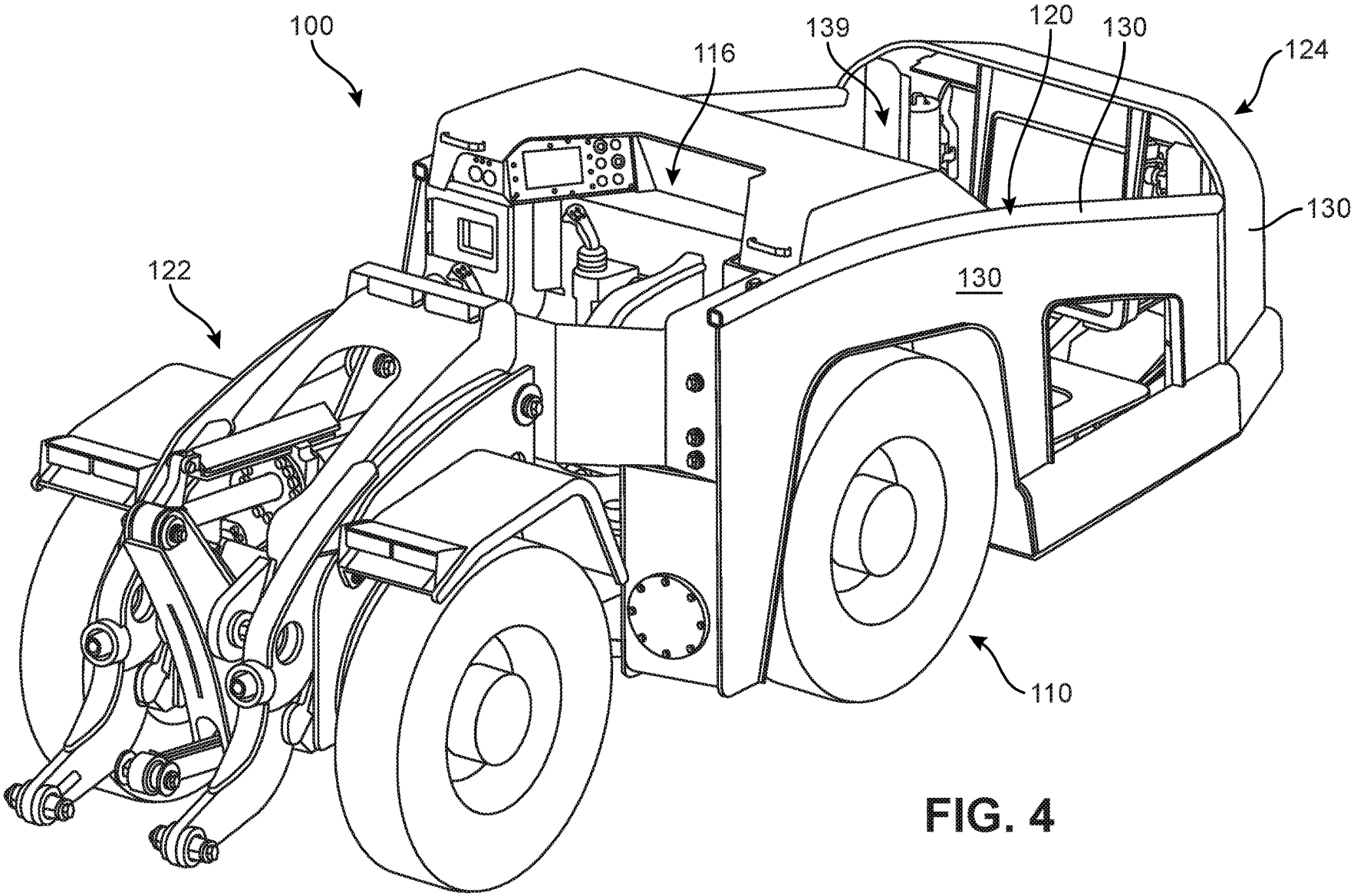
FIG. 4 shows an embodiment of a mining vehicle with some components removed for clarity.

Vehicle 100 includes vehicle body 120, which is best shown in FIGS. 3 and 4. Vehicle body 120 includes body structural supports (e.g., chassis components) as well as panels and other elements that protect or otherwise cover other elements of vehicle 100. In the embodiment of FIGS. 3 and 4, vehicle body 120 may be separated into first body portion 122 and a second body portion 124. First body portion 122 includes portions of vehicle body 120 that surround and support two of wheels 110 as well as scoop 112. Second body portion 124 includes portions of vehicle body 120 that surround and support onboard battery 104 (not shown in FIGS. 3-4), two of wheels 110, and passenger cab 116.

Second body portion 124 further includes rear chassis assembly 130. Rear chassis assembly 130 includes various chassis members that surround and support a battery. Specifically, rear chassis assembly 130 includes first side chassis member 132, second side chassis member 134, and rear chassis member 136. Together these chassis members form the side and rear walls of battery compartment 139.

Figure 5:
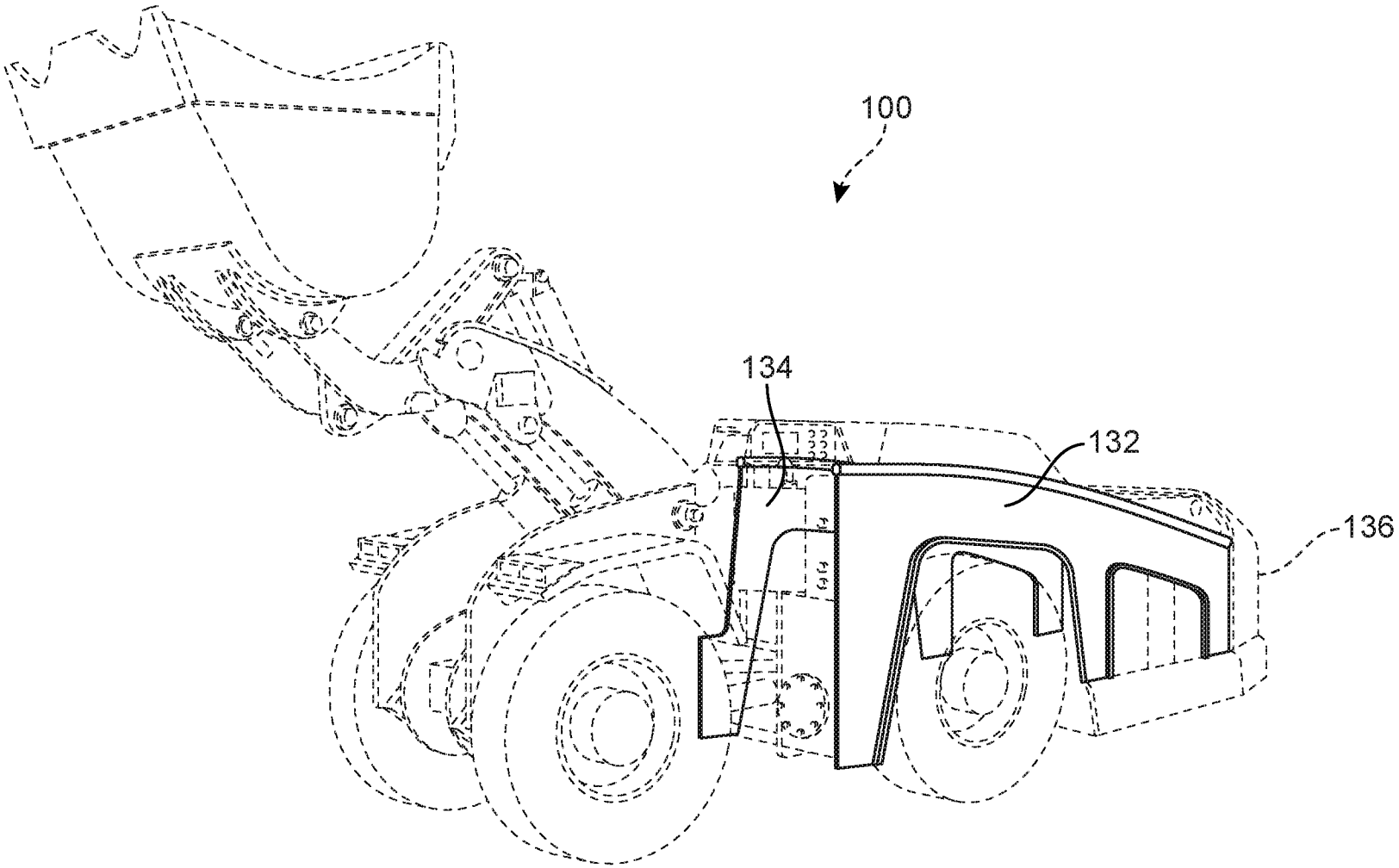
FIG. 5 shows an embodiment of a mining vehicle with some portions of a chassis highlighted.

As best seen in FIG. 5, first side chassis member 132 and second side chassis member 134 are positioned along the outer sides of vehicle 100. Likewise, rear chassis member 136 is positioned along the outer rear side of vehicle 100.

Figure 6:
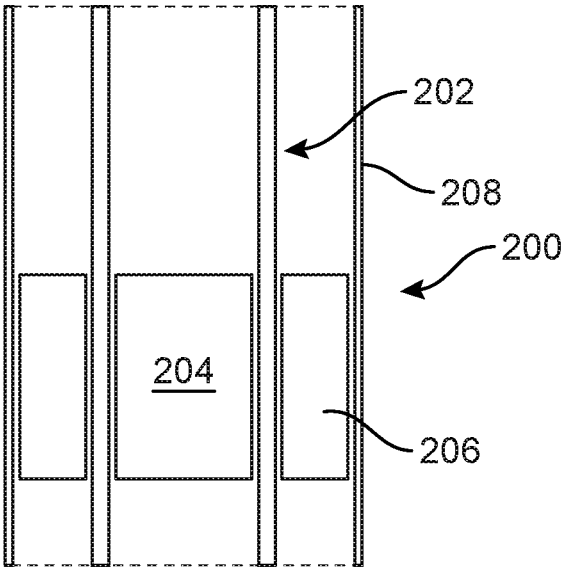
FIG. 6 shows a schematic view of two alternative constructions for a mining vehicle chassis.
Figure 6:
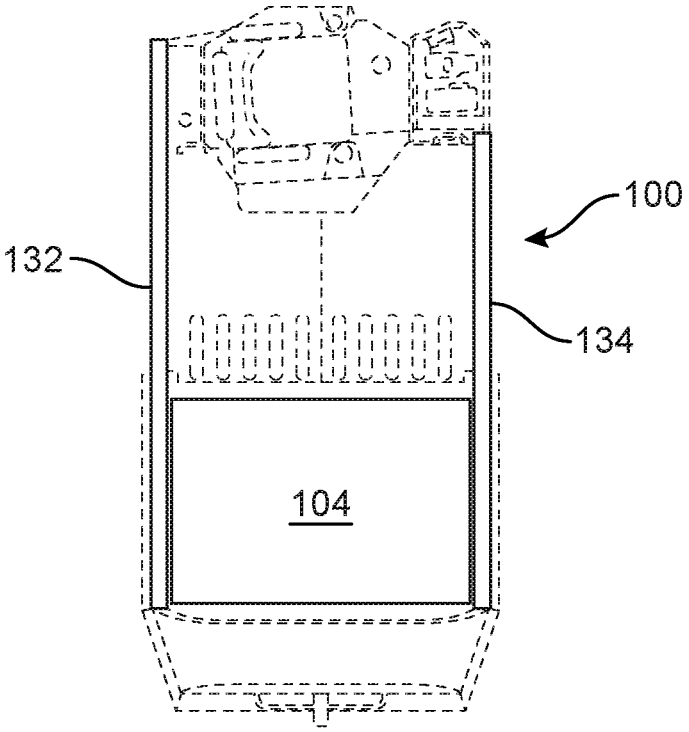

This configuration for the chassis of vehicle 100 may be seen to contrast with conventional chassis designs in diesel vehicles. This contrast is best seen in FIG. 6, which shows schematic views of a portion of vehicle 100 and a corresponding portion of alternative diesel vehicle 200. In the conventional design, diesel engine 204 may be supported by inner chassis elements 202 that are positioned inwardly from the sides of alternative diesel vehicle 200 to support the engine. Additional components, such as exhaust system 206 (shown schematically) may be positioned outside of the narrowly arranged inner chassis elements 202. These components may be held in place or covered by other framing elements 208 that extend on the exterior of alternative diesel vehicle 200. Framing elements 208 generally do not provide as much support and strength as inner chassis elements 202.

In contrast, the strongest portions of the frame or chassis of vehicle 100 are arranged on the outer sides of vehicle 100. In some cases, first side chassis member 132 and second side chassis member 134 may serve as both structural elements and the outermost parts of the frame of vehicle 100 along the sides. In other cases, first side chassis member 132 and second side chassis member 134 could be disposed adjacent to, and at least partially covered by, outer frame elements (e.g., sheets, bars, etc.).

Not only the position, but also the size, shape, and density of chassis elements of vehicle 100 may differ from those of alternative diesel vehicle 200. In some cases, first side chassis member 132 and second side chassis member 134 may be designed to increase the total weight of vehicle 100. That is, it may be desirable to use larger and/or heavier chassis elements for first side chassis member 132 and second side chassis member 134, as compared to the size and/or weight of inner chassis elements 202. In some embodiments, the chassis of vehicle 100 may be more comparable to a unibody chassis, while the chassis of alternative diesel vehicle 200 has more of a ladder frame type of chassis.

By using a heavier chassis, vehicle 100 is designed to incorporate a greater amount of mass than a conventional chassis used in diesel vehicles. This creates a higher density vehicle (more weight for the volume), which helps improve traction and overall stability of the machine. By contrast, it is generally desirable for the chassis in diesel vehicles to be as light as possible since diesel mining vehicles are often constrained to run at or below a predetermined horsepower to minimize exhaust emissions in the mine.

Some embodiments of a mining vehicle may include provisions for reducing the form factor of the vehicle compared with conventional diesel vehicles. In discussing the form factor, the description discusses the overall length, overall width, and overall height of a vehicle, as well as various other dimensions. As used herein, the term overall length refers to the distance between the forward-most location on a vehicle and the rearward-most location on the vehicle. In some cases, the forward-most location may be a location on the scoop. The term overall width refers to the distance between opposing sides of the vehicle, and is measured at the "outermost" locations along the opposing sides. The term overall height refers to the distance between the lowest point of a vehicle (usually the bottom of the wheels) and the highest point of a vehicle. When a canopy is present, the highest point of a vehicle is usually located on the canopy.

Figure 7:
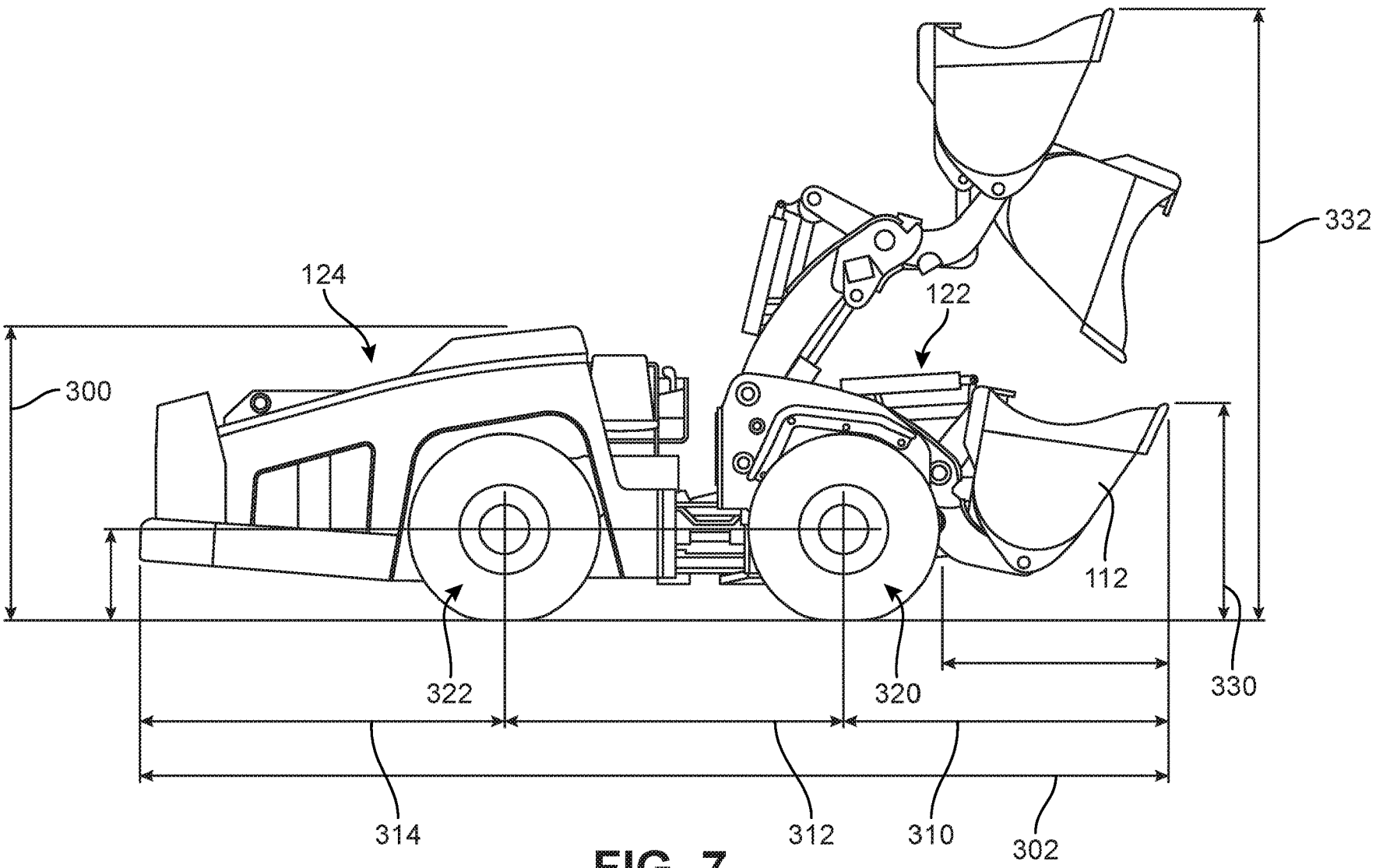
FIG. 7 shows a side schematic view of an embodiment of a mining vehicle in which a variety of dimensions are indicated.

FIG. 7 illustrates a side schematic view of vehicle 100 for purposes of illustrating a variety of dimensions. Vehicle 100 has overall height 300, measured from the ground vertically up to the highest point of vehicle 100. In one embodiment, overall height 300 has a value of approximately 1,651 millimeters (65 inches). In other embodiments, overall height 300 could have any value approximately in the range of 1,500 to 2,000 mm. In some other embodiments; vehicle 100 may be provided with a canopy. In such embodiments, the overall height of vehicle 100 may extend higher than the location where overall height 300 is measured in the example shown in FIG. 7.

Vehicle 100 has overall length 302, measured from the rearward-most location on second body portion 124 to the forward-most location on first body portion 122. In one embodiment, overall length 302 has a value of approximately 5,706 mm (224.6 in). In other embodiments, overall length 302 could have any value approximately in the range between 5,500 to 6,500 mm.

As seen in FIG. 7, the overall length of vehicle 100 can be separated into front overhang length 310, wheelbase length 312 and rear overhang length 314. Specifically, wheelbase length 312 is measured between the center of front wheels 320 and the center of rear wheels 322. Front overhang length 310 is measured from the center of front wheels 320 to the forward-most location on scoop 112. Rear overhang length 314 is measured from the center of rear wheels 322 to the rearward-most location on second body portion 124. In one embodiment, front overhang length 310 has a value of approximately 1,805 mm (71 in); wheelbase length 312 has a value of approximately 1; 880 mm (74 in); and rear overhang length 314 has a value of approximately 2,020 mm (79.5 in). Of course, in other embodiments, these values can be varied to accommodate desirable modifications to the wheelbase length, the length of the forward and/or rearward part of the body or to the size and/or extension of the scoop. Moreover; it may be understood that as the overall length is adjusted in different embodiments, the values of front overhang length 310, wheelbase length 312, and rear overhang length 314 may be varied accordingly.

The height of scoop 112 may vary according to its operating position. For example, in a fully lowered state, an upward-most location of scoop 112 has lowered scoop height 330 as measured from the ground. In one embodiment, lowered scoop height 330 has a value of approximately 1,220 mm (48 in). In a fully raised state, an upward-most location of scoop 112 has raised scoop height 332 as measured from the ground. In one embodiment, raised scoop height 332 has a value of approximately 3,408 mm (134.2 in).

Figure 8:
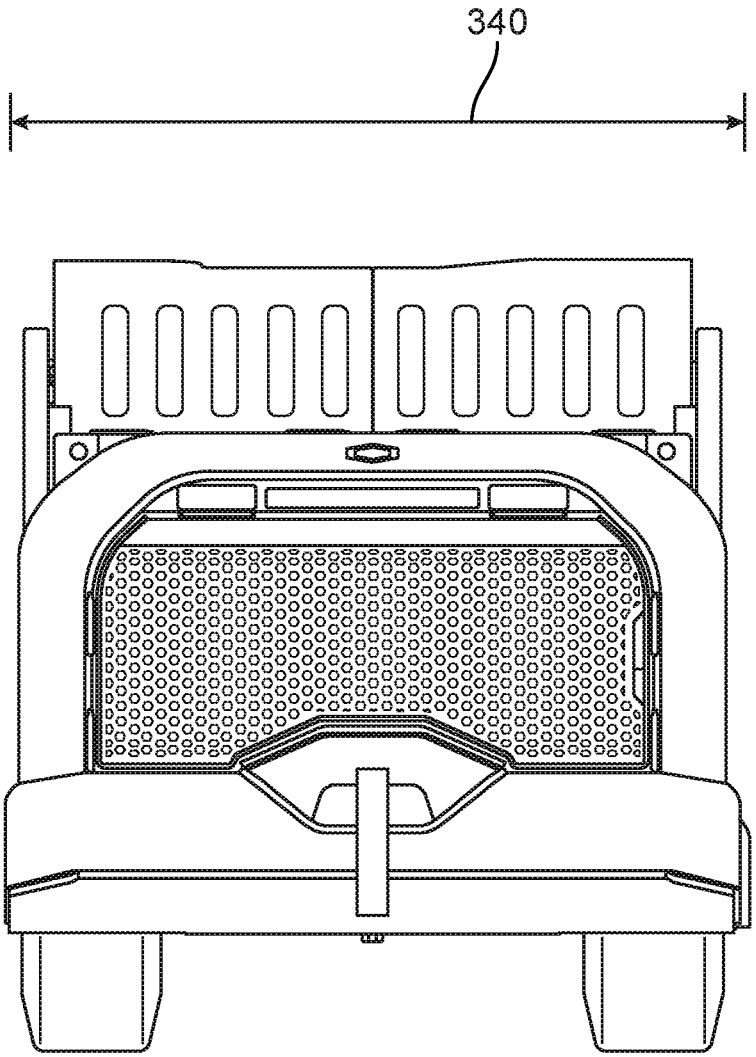
FIG. 8 shows a rear view of the mining vehicle of FIG. 1.

FIG. 8 shows a rearward view of vehicle 100. Vehicle 100 has overall width 340. In one embodiment, overall width 340 has a value of approximately 1,524 mm (60 in). In other embodiments, overall width 340 could have any value approximately in the range of 1; 400 to 1,600 mm.

Figure 9:
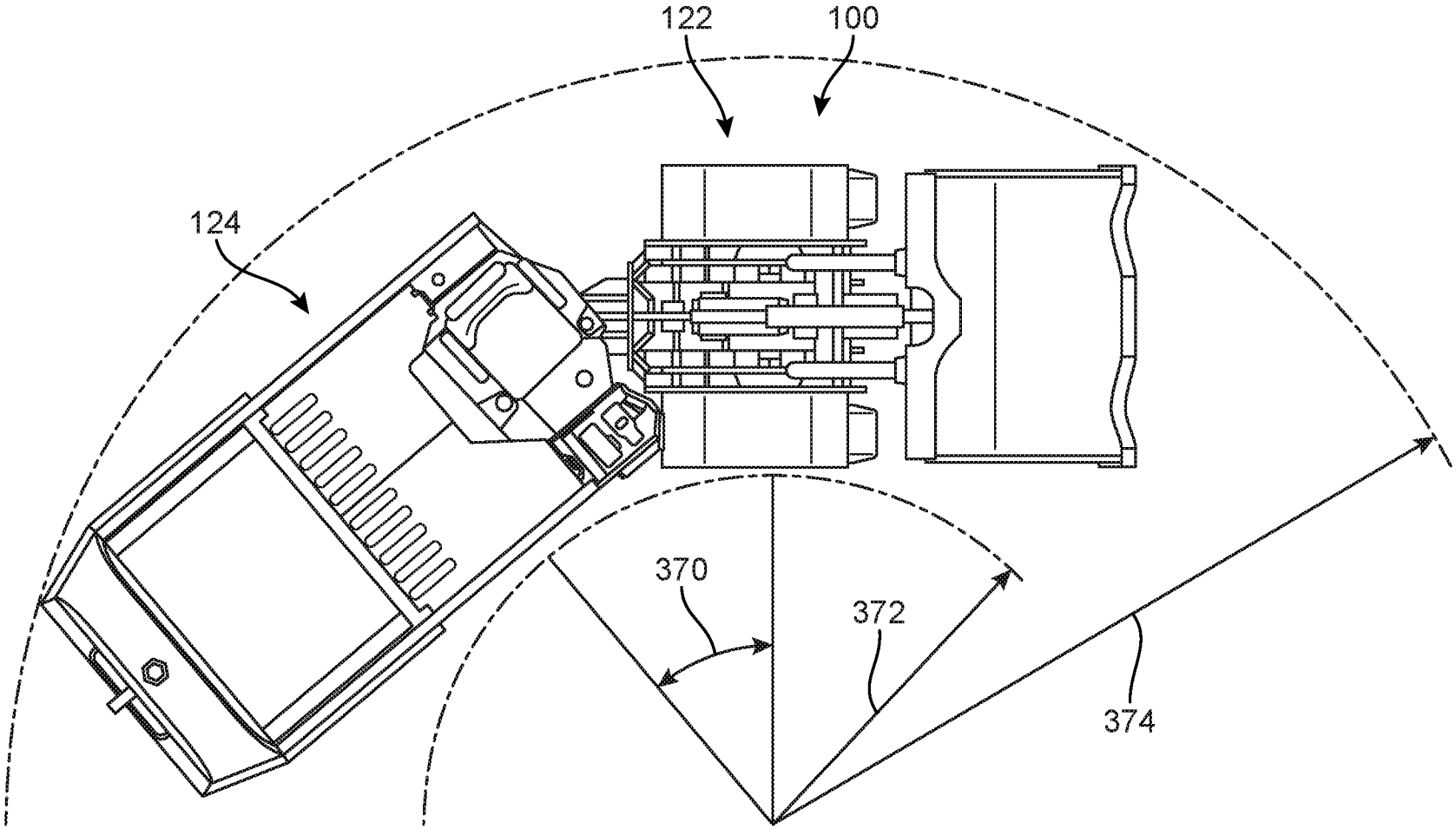
FIG. 9 shows an embodiment of a mining vehicle turning, according to an embodiment.

FIG. 9 is a schematic view of vehicle 100 in a turning position. In particular, first body portion 122 is angled with respect to second body portion 124 at angle 370. In one embodiment, angle 370 has a value of approximately 40 degrees. In other embodiments, angle 370 could have any value approximately in the range between 30 and 50 degrees. In addition; the inner turning path has radius 372. The outer turning path has radius 374. In one embodiment, radius 372 has a value of approximately 1,803 mm (or 81 in). Also, in one embodiment, radius 374 has a value of approximately 3,785 mm (or 149 in). Of course, any of angle 370; radius 372, and/or radius 374 could be varied in other embodiments as the length and/or width of the vehicle are varied, and/or as other features are modified (such as the mechanical linkage between first body portion 122 and second body portion 124).

Vehicle 100 may be characterized by a footprint as well as an envelope; which are two-dimensional and three-dimensional representations of the vehicle's form factor. As used herein, the term "vehicle footprint area" is equal to the product of the overall length and the overall width of a vehicle. In addition, the term "vehicle envelope volume" is equal to the product of the vehicle footprint area and the overall height of the vehicle.

Figure 10:
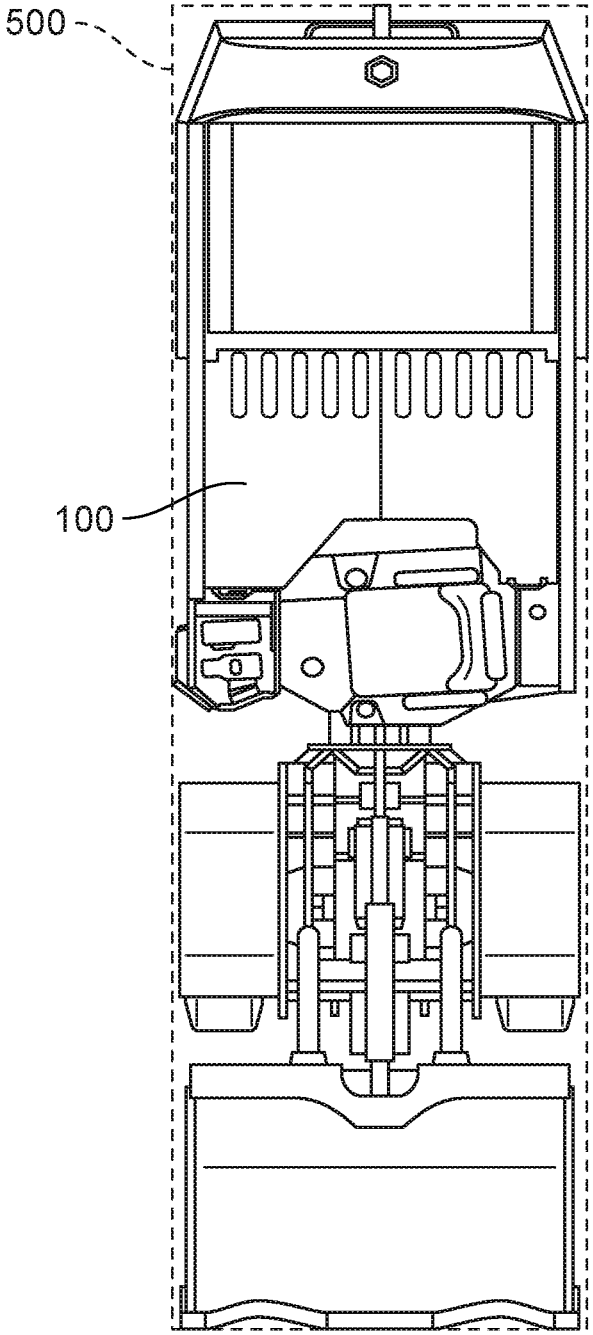
FIG. 10 shows a schematic view of a footprint for a mining vehicle, according to an embodiment.
Figure 11:
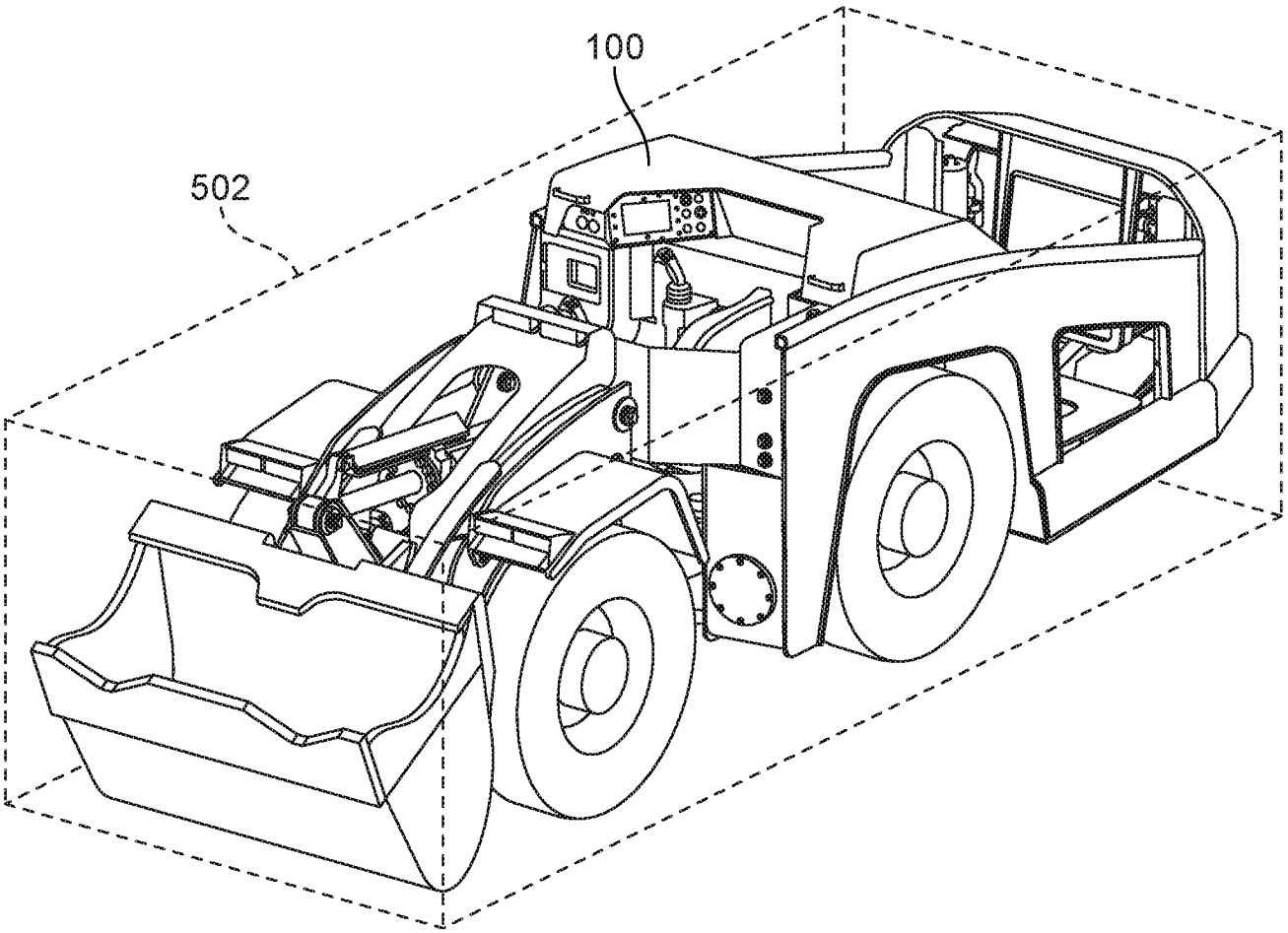
FIG. 11 shows a schematic view of a three-dimensional envelope for a mining vehicle, according to an embodiment.

As seen in FIGS. 10-11, vehicle 100 has vehicle footprint area 500. Vehicle 100 also has vehicle envelope volume 502. In one embodiment, vehicle footprint area 500 has a value of approximately 8.7 $m^2$. Similarly, vehicle envelope volume 502 has a value of approximately 14.4 $m^3$. Of course, in other embodiments, both the footprint area and the envelope volume may be varied by changing one or more of the overall length, overall width, or overall height of vehicle 100. In some other embodiments, the vehicle footprint area may have any value approximately in the range of 8 to 10 $m^2$. Also, the vehicle envelope volume may have any value approximately in the range of 14 to 20 $m^3$.

Figure 12:
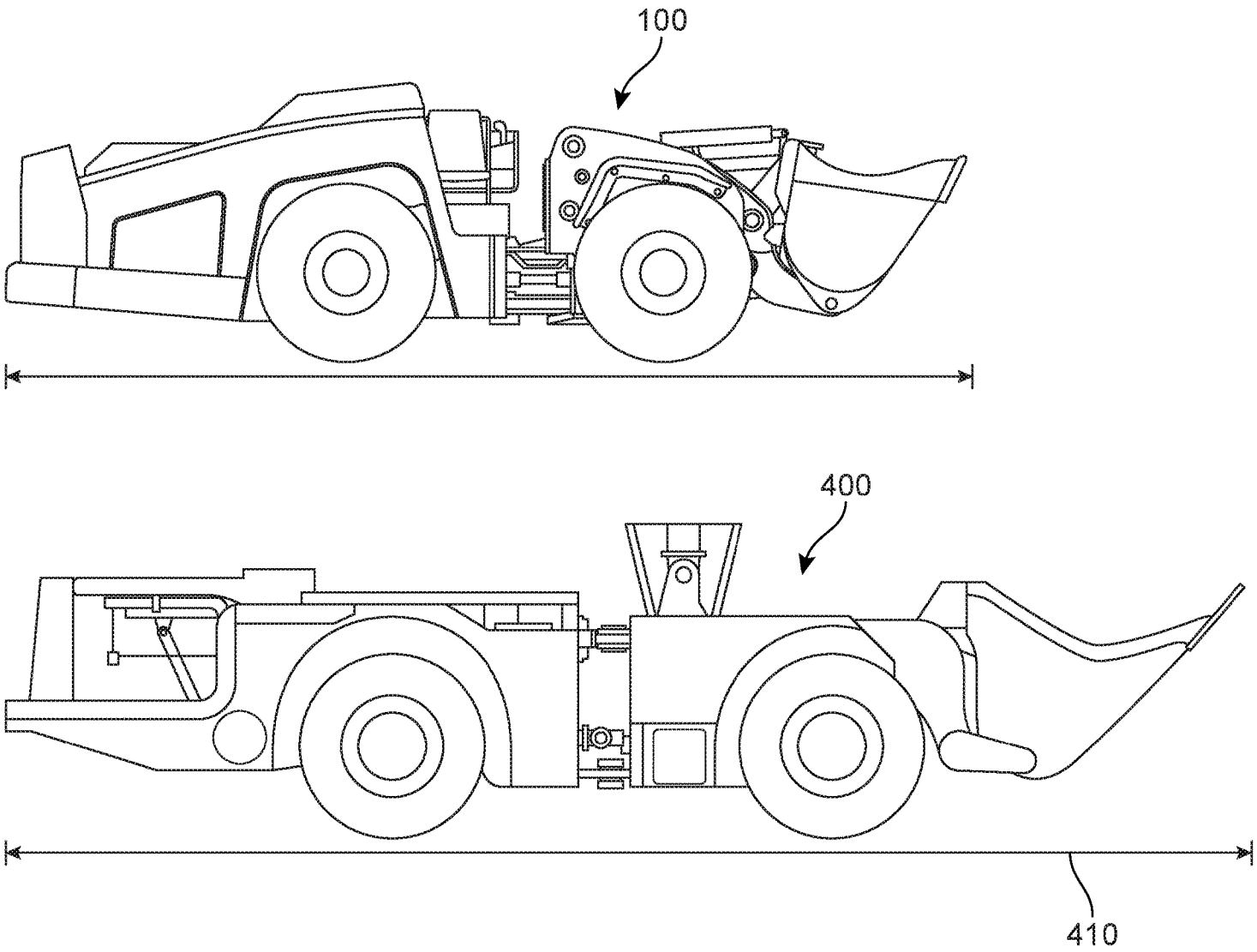
FIG. 12 shows a comparison of the sizes of two different mining vehicles, according to an embodiment.

FIG. 12 depicts a schematic view of vehicle 100 and benchmark vehicle 400. Here, benchmark vehicle 400 is intended to represent a conventional mining vehicle that may have similar hauling capacity (for example, around 3 metric ton hauling capacity). For example, benchmark vehicle 400 could be a diesel-powered mining vehicle with a hauling capacity of 3 metric tons.

For purposes of comparison, benchmark vehicle 400 is shown to have the following specifications that may be representative of conventional mining vehicles with a hauling capacity close to 3 metric tons. In particular, benchmark vehicle 400 has length 410 with a value of approximately 6,365 mm.

As clearly seen in FIG. 12, vehicle 100 has a substantially shorter length than benchmark vehicle 400. In an embodiment where vehicle 100 has overall length 302 of approximately 5,706 mm, this results in vehicle 100 being shorter than benchmark vehicle 400 by approximately 660 mm. In other words, vehicle 100 provides more than a 10 percent reduction in length compared to benchmark vehicle 400.

In some embodiments, vehicle 100 may have a similar width to benchmark vehicle 400. In one embodiment, benchmark vehicle 400 has an overall width of 1,514 mm compared to the overall width of vehicle 100 (shown in FIG. 8) of 1,524 mm. In other embodiments, vehicle 100 may have a substantially reduced width compared to benchmark vehicles. In some embodiments, vehicle 100 may have a smaller height compared to conventional mining vehicles with a similar hauling capacity. For example, benchmark vehicle 400 has an overall height of 1,895 mm. In contrast, in one embodiment, vehicle 100 may have an overall height of 1,651 mm. Though, as seen in FIG. 12, some of this height difference may result from the lack of a canopy on vehicle 100. With an optional canopy, the overall height of vehicle 100 may be increased. In such cases, the envelope volume may also be increased relative to a vehicle without a canopy.

It may be seen that vehicle 100 is provided with a substantial reduction in size of at least one of the overall length, overall width, and/or overall height compared to conventional mining vehicles of similar hauling capacity. This reduction may result in a smaller vehicle footprint area and/or a smaller vehicle envelope volume.

The smaller form factor creates a smaller heading for the mining vehicle. This results in significantly less rock displacement during the mining operation and thereby provides significant cost improvements over mining operations using vehicles with larger sizes/headings. Moreover, the smaller form factor may also contribute to increased visibility as discussed further below.

The invention is directed to an improved line of sight or visibility for the mining vehicle. This improved line of sight is achieved by way of the reduced lengthwise form factor and the chassis/frame shape at the battery (in red) end of the vehicle. The shortened length along with the sloped chassis/frame shape (vs. a horizontal shape for conventional designs) allows for an improved line of sight when compared to the line of sight achieved in conventional designs.

As used herein, a sightline is a line of visibility between a driver/operator of a vehicle and some location away from the vehicle. If a driver/operator has a clear sightline to a location, then the location is visible. The term "ground visibility distance" refers to the horizontal distance between the cab of a vehicle (i.e., where the operator sits) and the nearest location on the ground at which a driver has a sightline to the ground (i.e., the shortest possible horizontal distance for which the driver can see the ground).

Figure 13:
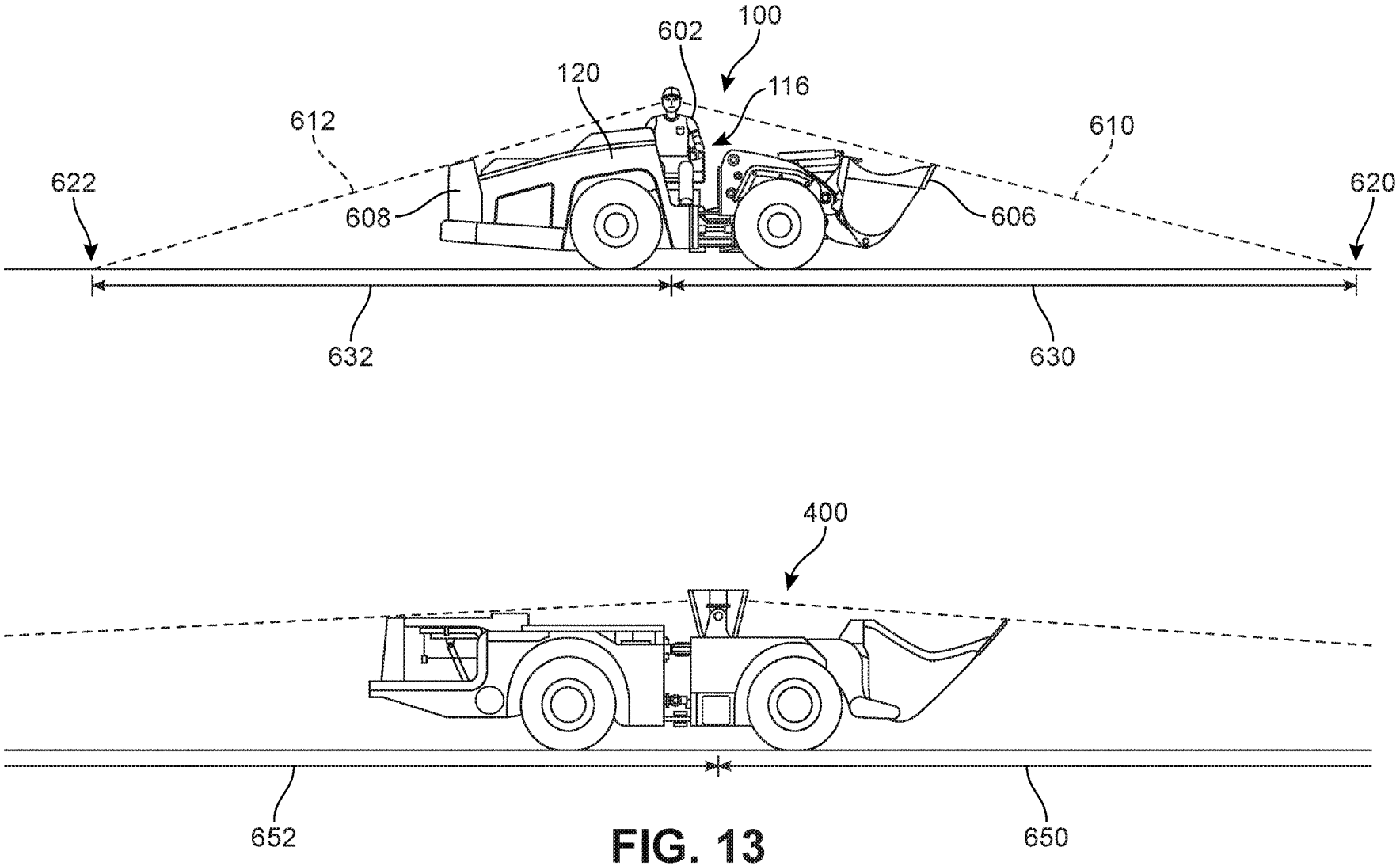
FIG. 13 shows a comparison of the degree of visibility available in two different mining vehicles according to an embodiment.

FIG. 13 shows schematic views of vehicle 100 and benchmark vehicle 400, for purposes of comparing the sightlines of the two designs. In FIG. 13, vehicle 100 and benchmark vehicle 400 are shown to differ substantially due to differences in the vehicles' form factors. Referring to FIG. 13, the relatively short length of vehicle 100 along with the distinctive geometry of vehicle body 120 provides significantly improved sightlines for a driver. In particular, driver 602 positioned within passenger cab 116 has clear sightline 610 to first location 620 (when the scoop is lowered) and second clear sightline 612 to second location 622. Here, first location 620 represents the closest part of the ground that is visible to driver 602 over first end portion 606 of vehicle 100. The horizontal distance between driver 602 and first location 620 is first ground visibility distance 630. Likewise, second location 622 represents the closest part of the ground that is visible to driver 602 over second end portion 608. The horizontal distance between driver 602 and second location 622 is second ground visibility distance 632. In one embodiment, the value of first ground visibility distance 630 could be approximately 9.4 meters (31 feet) and the value of second ground visibility distance 632 could be approximately 7.9 meters (26 feet). In other embodiments, first ground visibility distance 630 and second ground visibility distance 632 could have any values approximately in the range between 5 and 30 meters.

By contrast, the sightlines provided to a driver (not shown) in benchmark vehicle 400 are significantly worse. In the example shown in FIG. 13, benchmark vehicle 400 provides first ground visibility distance 650 (over the scoop) of around 15 meters (50 feet). Benchmark vehicle 400 also provides second ground visibility distance 652 over the rear of the vehicle of around 30 meters (100 feet).

Thus, the exemplary embodiment of vehicle 100 provides a ground visibility distance over the front of the vehicle (or the scoop end) that is approximately 38 percent shorter than the ground visibility distance of benchmark vehicle 400. Likewise, vehicle 100 provides a ground visibility distance over the rear of the vehicle (opposite the scoop end) that is 75 percent shorter than the ground visibility distance of benchmark vehicle 400. This significant improvement in visibility (i.e., reduced ground visibility distances) translates to better maneuverability for the driver of vehicle 100.

In some cases, the degree of visibility can be measured using an H-point machine and a laser that rotates about a location where a driver's head would be. Such a method, already known in the art for evaluating front and rear visibility in traditional cars, may be used to provide an accurate measurement of the location on the ground at which the driver's view first becomes obstructed.

FIGS. 14 through 19 are charts comparing various performance parameters for vehicle 100 and benchmark vehicle 700. It may be appreciated that the values given in the charts may be understood as representative of values for a given embodiment, and in other embodiments these values could vary. The parameters discussed here are ratios of hauling capacity to other vehicle characteristics such as vehicle length, footprint area, envelope volume, and visibility distance.

For purposes of making these comparisons, the following specifications for benchmark vehicle 700 have been used: a hauling capacity of 2.7 metric tons; dimensions of 6.3×1.6×1.5 (L×W×H in meters); ground visibility distance of 15 meters (in a forward direction) and 30 meters (in a rearward direction); and weight of 9.6 metric tons. Moreover, the values indicated for vehicle 100 in FIGS. 14-19 are determined using exemplary parameters discussed above. These include a hauling capacity of 3 metric tons; dimensions of 5.7×1.5×1 0.6 (L×W×H in meters); ground visibility distance of 9.5 meters (in the forward direction) and 8 meters (in the rearward direction); and weight of 9.5 metric tons.

Figure 14:
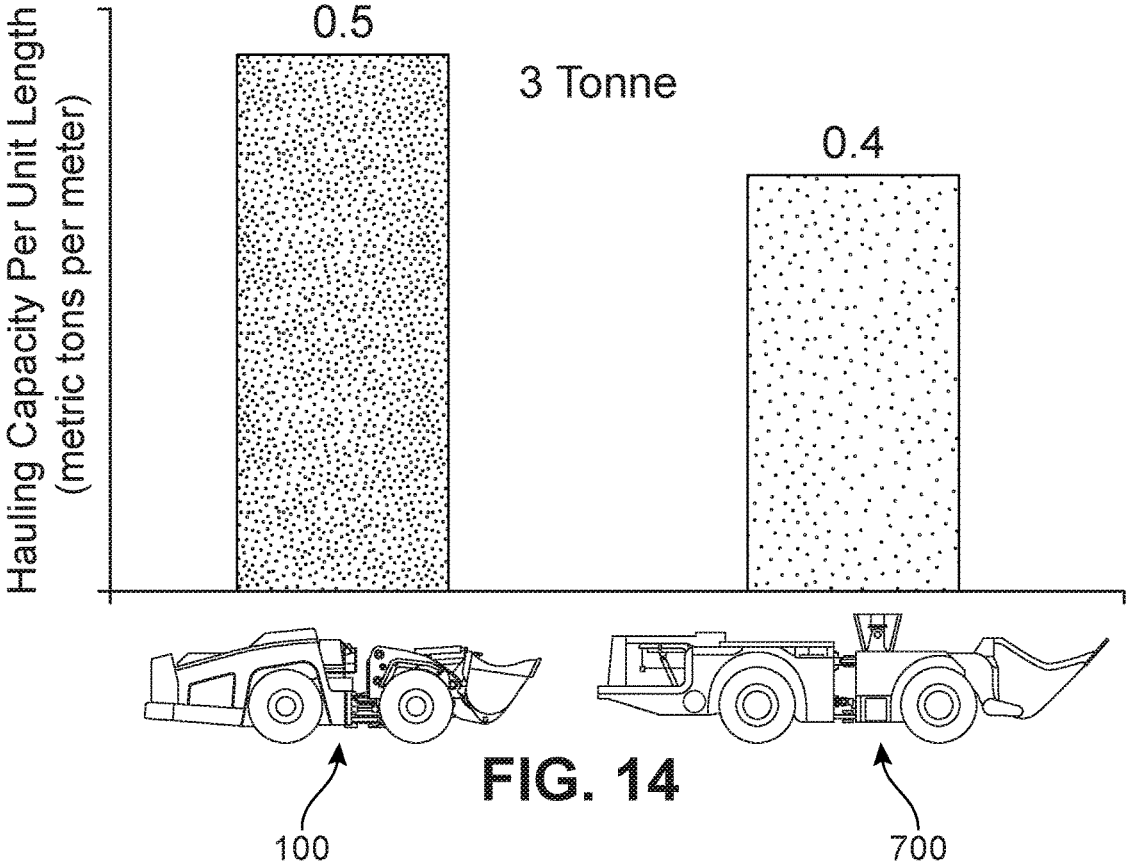
FIGS. 14-17 show charts of the ratio of the hauling capacity to another characteristic parameter for two different mining vehicles having a hauling capacity in a range between 2.7-3 metric tons, according to an embodiment.

As previously discussed, the smaller length for vehicle 100 as compared to benchmark vehicle 700 provides for a greater hauling capacity per unit length. This comes about since vehicle 100 achieves this reduced length without sacrificing hauling capacity compared to vehicles in a similar class. As seen in FIG. 14, this parameter has a value of 0.5 metric tons per meter for vehicle 100 and 0.4 metric tons per meter for benchmark vehicle 700. In other embodiments, vehicle 100 could have a hauling capacity per unit length with any value approximately in the range of 0.45 to 0.6 metric tons per meter.

Figure 15:
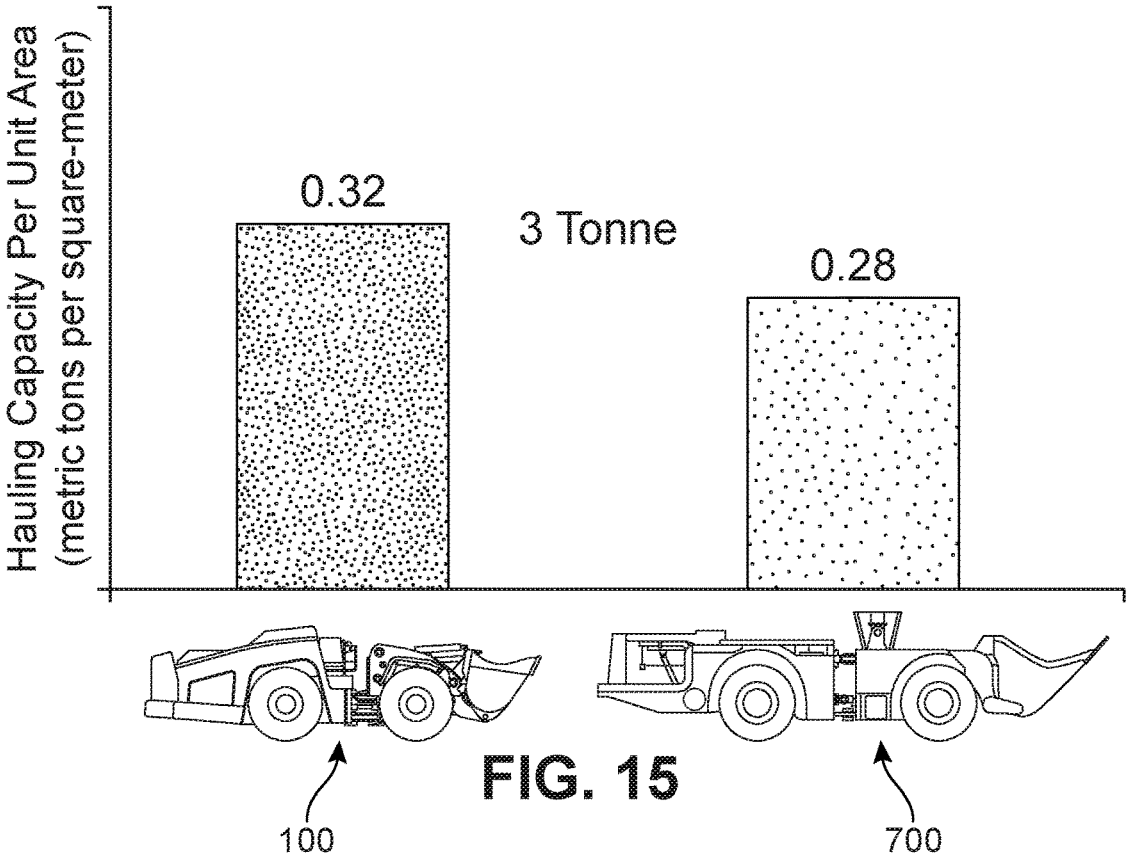

As seen in FIG. 15, vehicle 100 has a greater hauling capacity per unit area than benchmark vehicle 700 (0.32 metric tons per meters-squared vs. 0.28 tons per meters-squared). In other embodiments, the hauling capacity per unit area of vehicle 100 could have any value approximately in the range between 0.3 and 0.4 metric tons per meters-squared.

Figure 16:
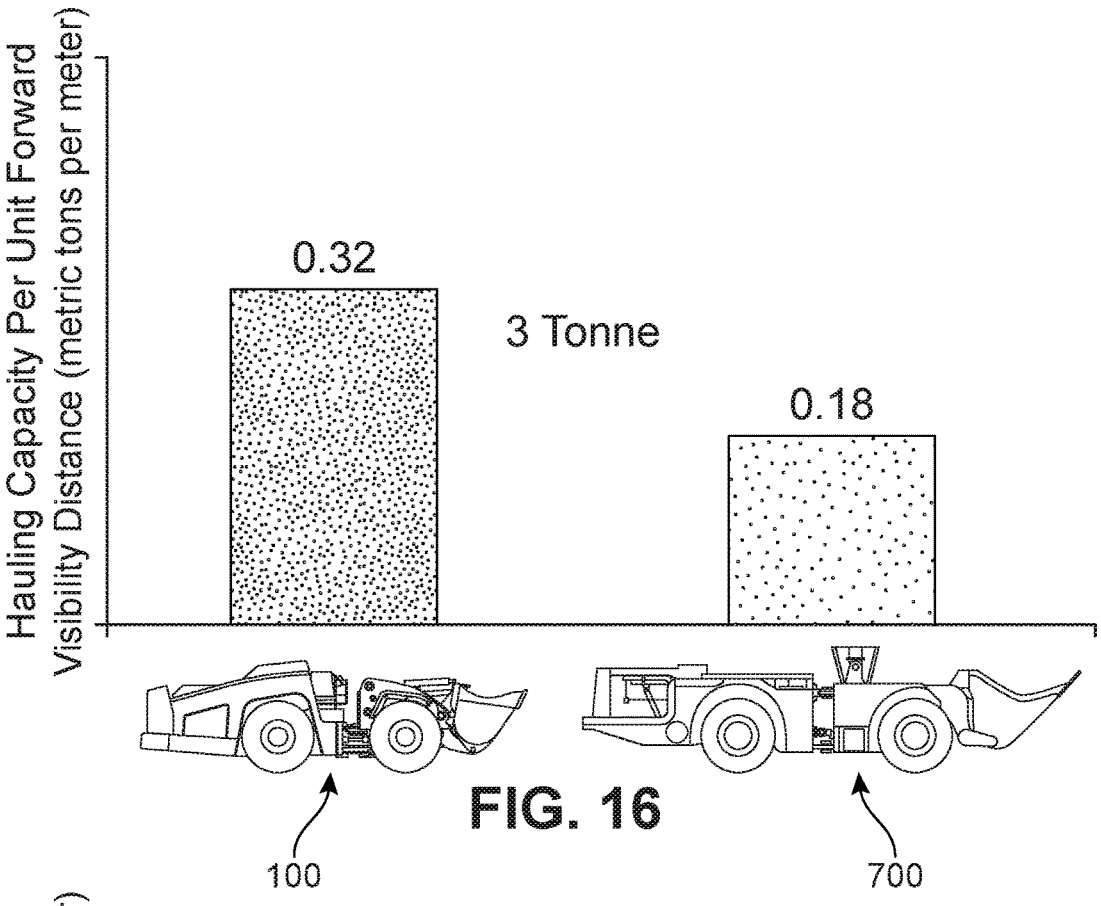

As seen in FIG. 16, vehicle 100 has a greater hauling capacity per unit of front ground visibility distance than benchmark vehicle 700 (0.32 metric tons per meter vs. 0.18 metric tons per meter). In other embodiments, vehicle 100 may have a hauling capacity per unit of ground visibility distance with any value approximately in the range between 0.2 and 0.4 metric tons per meter.

Figure 17:
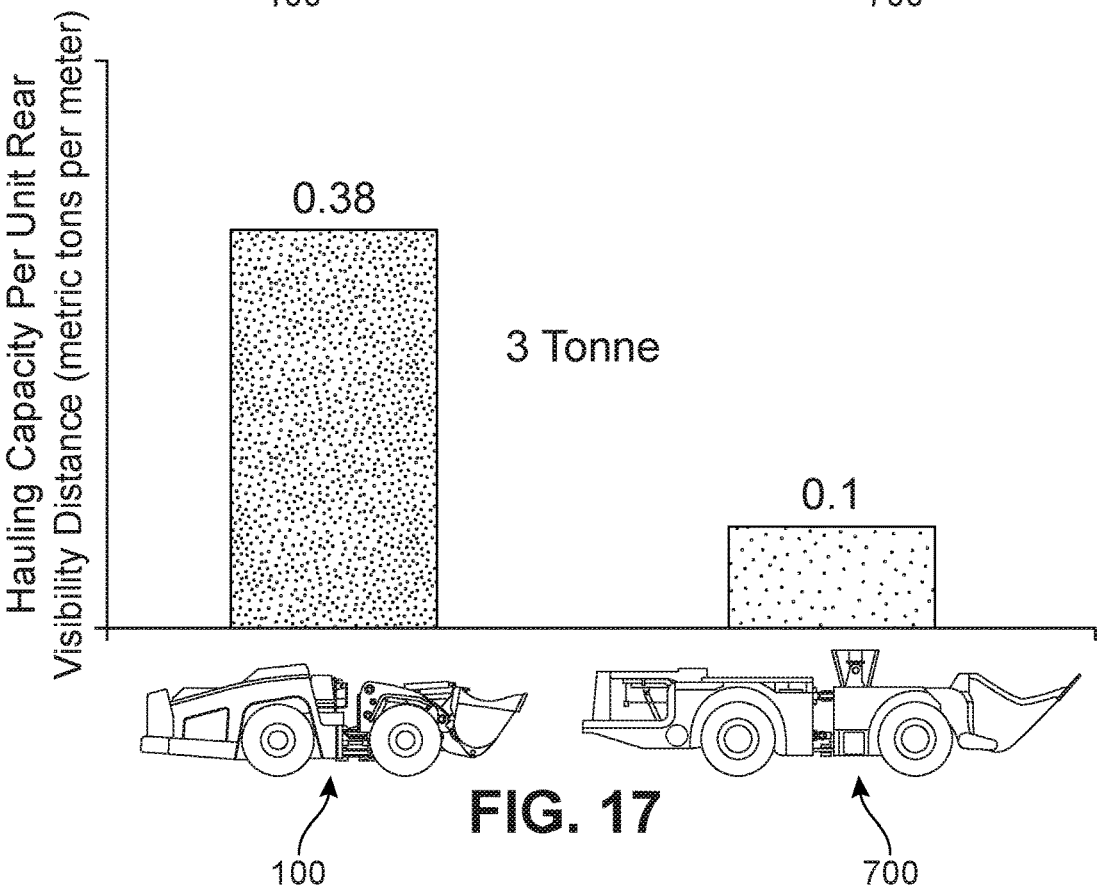

As seen in FIG. 17, vehicle 100 has a greater hauling capacity per unit of rear ground visibility distance than benchmark vehicle 700 (0.38 metric tons per meter vs. 0.1 metric tons per meter). In other embodiments, vehicle 100 may have a hauling capacity per unit of ground visibility distance with any value approximately in the range between 0.2 and 0.5 metric tons per meter.

Figure 18:
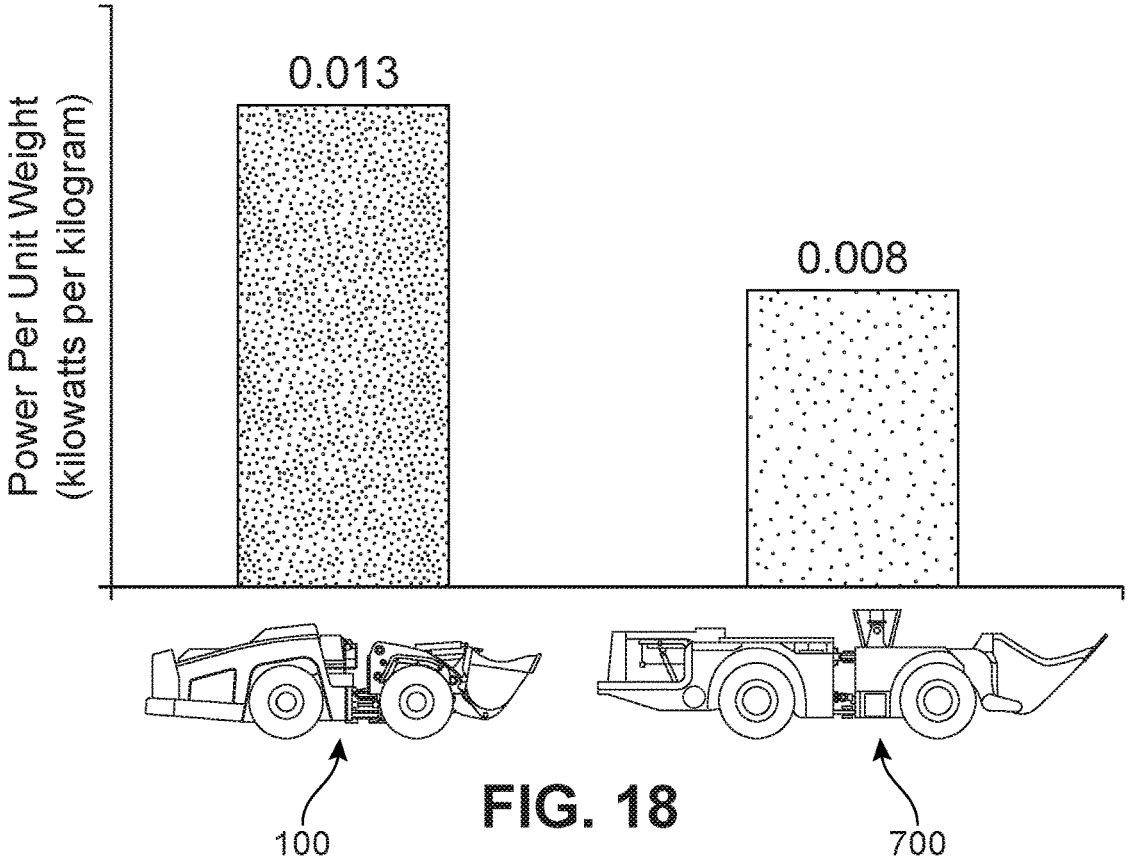
FIG. 18 shows a chart of the ratio of power to vehicle weight for two different mining vehicles, according to an embodiment.
Figure 19:
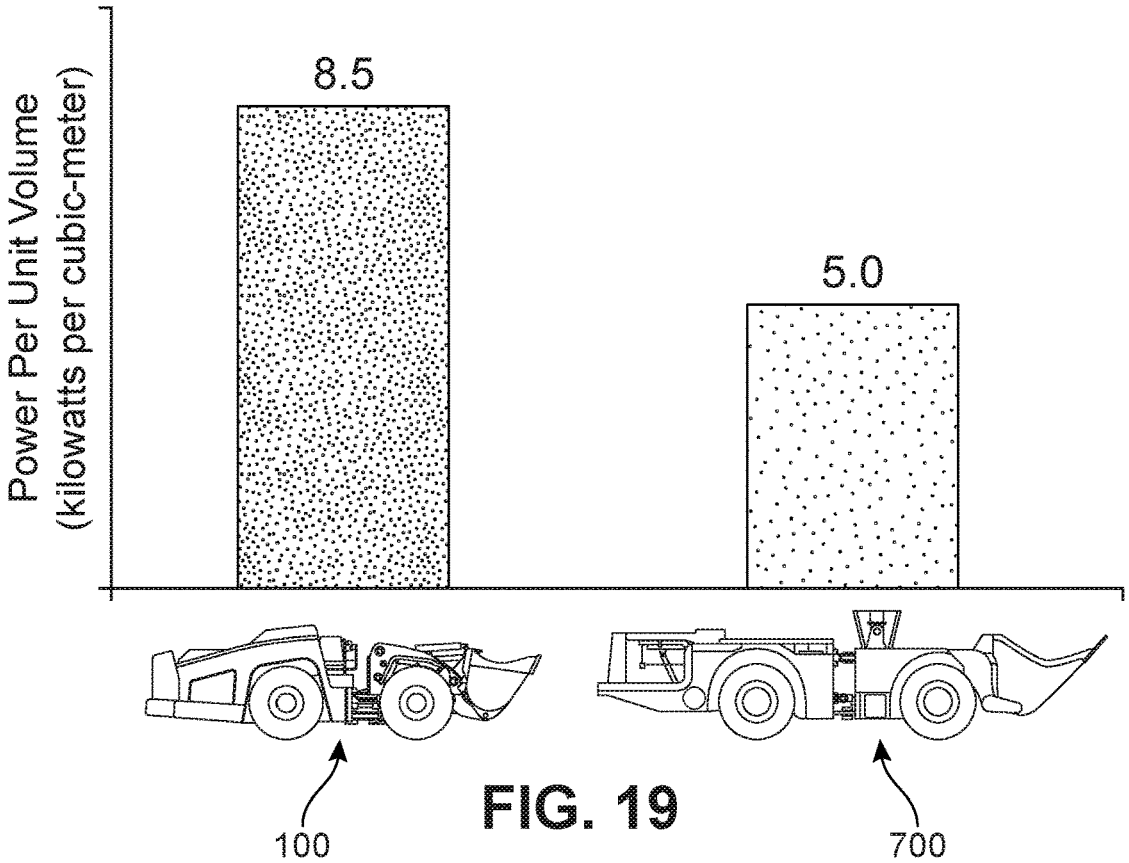
FIG. 19 shows a chart of the ratio of power to vehicle volume for two different mining vehicles, according to an embodiment.

Embodiments can include provisions to provide increased vehicle handling. Mining vehicles that utilize electric motors may provide increased power when compared to diesel vehicles with similar hauling capacities. For example, one embodiment of vehicle 100 includes an electric motor that operates at a continuous power approximately in the range of 80 to 90 kilowatts. In some cases, vehicle 100 may operate at a peak power approximately in the range of 120-130 kilowatts. In contrast, a benchmark vehicle 700 with a hauling capacity of 2.7 metric tons may only operate with a peak power of 74 kilowatts. For reference the ratio of power to weight may be referred to herein as a "vehicle handling parameter," as it may be considered a measure of how well the vehicle responds to input from the driver (e.g., how a vehicle responds during cornering, acceleration and breaking). In one embodiment, vehicle 100 may have a weight in the range approximately of 9400 to 9600 kilograms while vehicle 700 has a weight of 9600 kilograms. As shown in FIG. 18, the vehicle handling parameter (power to weight) for vehicle 100 may have a value of approximately 0.013 kilowatts per kilogram. In contrast, benchmark vehicle 700 may have a vehicle handling parameter of 0.008 kilowatts per kilogram. In some embodiments, the vehicle handling parameter of vehicle 100 could have a value approximately in the range between 0.1 and 0.15 kilowatts per kilogram.

Embodiments can include provisions to improve the power to volume ratio (or power density) of a vehicle. In the exemplary embodiment, vehicle 100 may have an envelope volume approximately in a range between 15 and 16 cubic-meters. Vehicle 700 may have an envelope volume of 14.5 cubic-meters. Moreover, the power to volume ratio for vehicle 100 may be approximately in the range between 7 and 9 kilowatts per cubic-meter. In one embodiment, the power to volume ratio for vehicle 100 is approximately 8.5 kilowatts per cubic meter. In contrast, benchmark vehicle 700 may have a power to volume ratio of 5 kilowatts per cubic-meter. This increased power density compared to other mining vehicles helps with improved performance in a mining environment where space (and therefore vehicle volume) may be constrained.

FIGS. 20 through 23 are charts comparing various performance parameters for another embodiment of vehicle 800 and benchmark vehicle 900. It may be appreciated that the values given in the charts may be understood as representative of values for a given embodiment, and in other embodiments these values could vary. The parameters discussed here are ratios of hauling capacity to other vehicle characteristics such as vehicle length, footprint area, envelope volume, and visibility distance, and vehicle density.

For purposes of making these comparisons, the following specifications for benchmark vehicle 900 have been used: a hauling capacity of 4 metric tons; dimensions of 7.6×1.7×1.5 (L×W×H in meters); ground visibility distance of 15 meters (in a forward direction) and 30 meters (in a rearward direction); and weight of 14.5 metric tons. Moreover, some of the values indicated for vehicle 800 in FIGS. 20-23 are similar to those of vehicle 800. These include dimensions of 5.7×1.5×1.6; ground visibility distance of 9.5 meters (in the forward direction) and 8 meters (in the rearward direction); and weight of 9.5 metric tons. Vehicle 800 may have a hauling capacity of approximately 4 metric tons.

Figure 20:
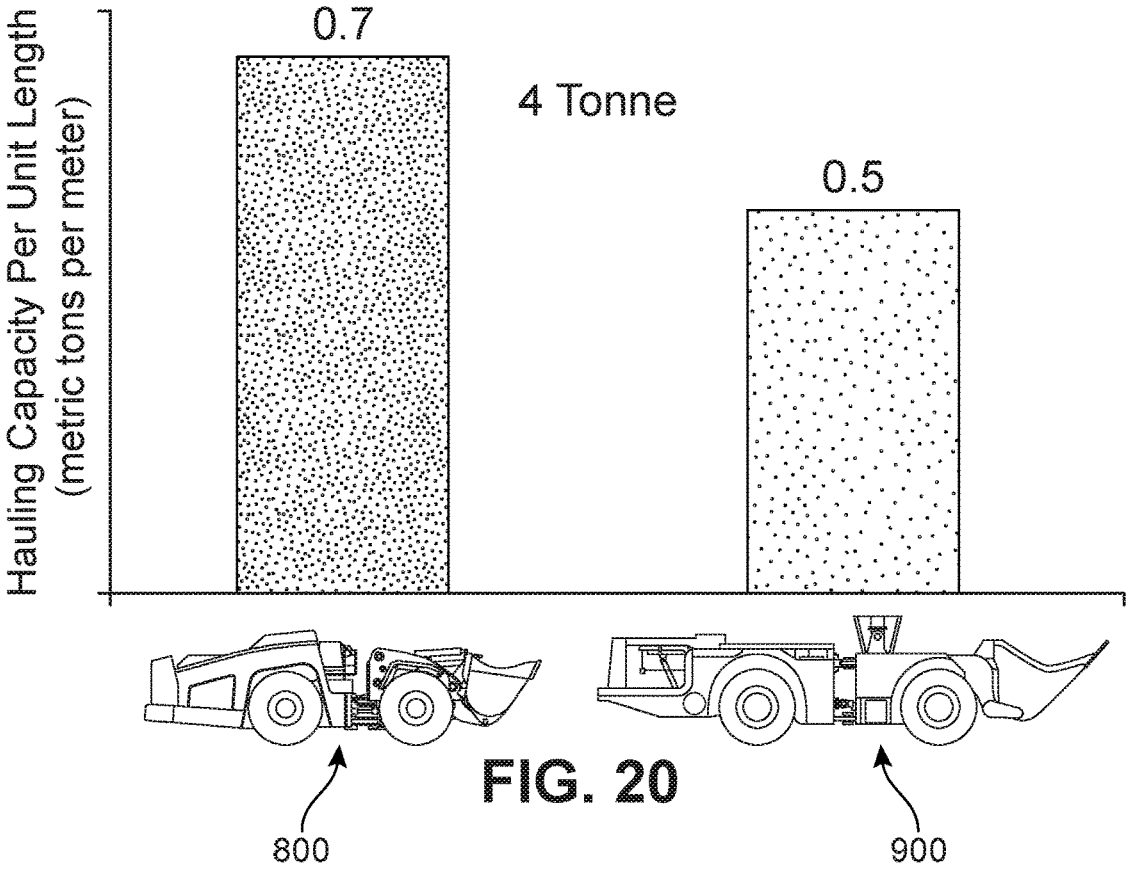
FIGS. 20-23 show charts of the ratio of the hauling capacity to another characteristic parameter for two different mining vehicles having a 4 metric ton capacity, according to an embodiment.

As seen in FIG. 20 vehicle 800 has a hauling capacity per unit length approximately in the range between 0.6 and 0.8 metric tons per meter. In one embodiment, vehicle 800 has a hauling capacity per unit length of approximately 0.7 metric tons per meter. By contrast, benchmark vehicle 900 has a hauling capacity per unit length of 0.5 metric tons per meter.

Figure 21:
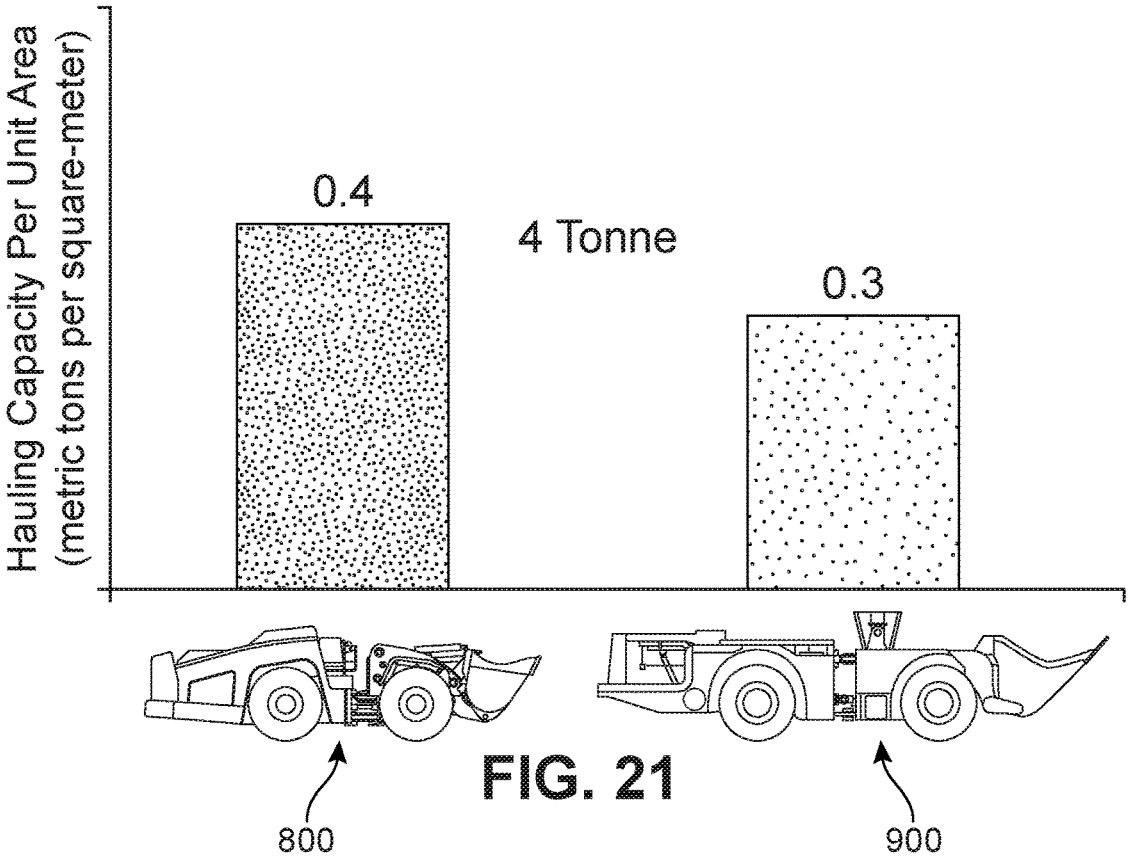

As seen in FIG. 21, vehicle 800 has a greater hauling capacity per unit area than benchmark vehicle 900 (0.4 metric tons per meters-squared vs. 0.3 tons per meters-squared). In other embodiments, the hauling capacity per unit area of vehicle 800 could have any value approximately in the range between 0.35 and 0.45 metric tons per meters-squared. Although not shown in the figures, in some embodiments, vehicle 800 may have a greater hauling capacity per volume than benchmark vehicle 900 (0.25 metric tons per cubic-meter vs. 0.19 metric tons per cubic-meter).

Figure 22:
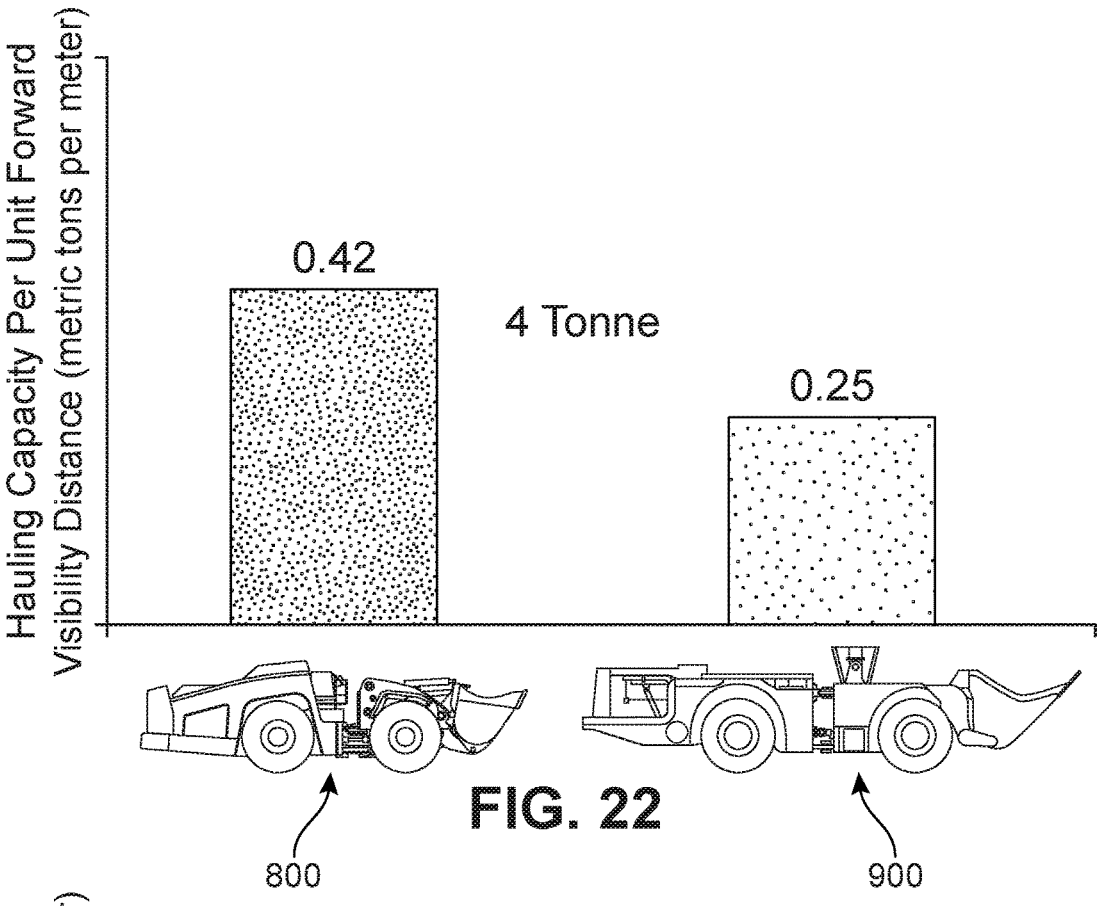

As seen in FIG. 22, vehicle 800 has a greater hauling capacity per unit of front ground visibility distance than benchmark vehicle 900 (0.42 metric tons per meter vs. 0.26 metric tons per meter). In other embodiments, vehicle 800 may have a hauling capacity per unit of ground visibility distance with any value approximately in the range between 0.3 and 0.5 metric tons per meter.

Figure 23:
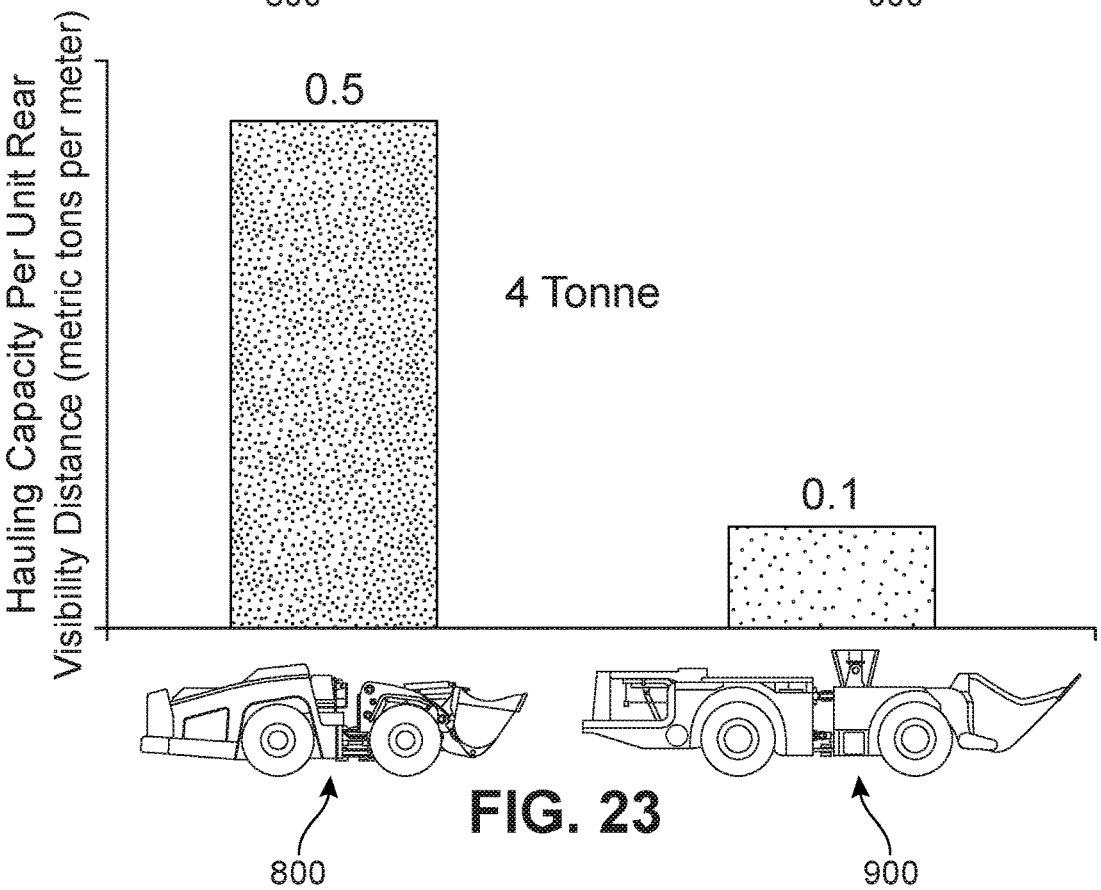

As seen in FIG. 23, vehicle 800 has a greater hauling capacity per unit of rear ground visibility distance than benchmark vehicle 900 (0.5 metric tons per meter vs. 0.1 metric tons per meter). In other embodiments, vehicle 800 may have a hauling capacity per unit of ground visibility distance with any value approximately in the range between 0.3 and 0.6 metric tons per meter.

Although not shown in the figures, vehicle 800 may also have improved power to weight and power to volume over benchmark vehicle 900. In embodiments where vehicle 800 has a peak power of 127 kilowatts and vehicle 900 has a peak power of 97 kilowatts, vehicle 800 may have a power to weight ratio of approximately 0.013 kilowatts per kilogram compared to a power to weight ratio of only 0.006 kilowatts per kilogram for benchmark vehicle 900. Similarly, vehicle 800 may have a power to volume ratio of approximately 8.5 kilowatts per cubic-meter compared to a power to volume ratio of 4.6 kilowatts per cubic-meter for benchmark vehicle 900.

While various embodiments of the invention have been described, the description is intended to be exemplary, rather than limiting, and it will be apparent to those of ordinary skill in the art that many more embodiments and implementations are possible that are within the scope of the invention. Any element of any embodiment may be substituted for another element of any other embodiment or added to another embodiment except where specifically excluded. Accordingly, the invention is not to be restricted except in light of the attached claims and their equivalents. Also, various modifications and changes may be made within the scope of the attached claims.

The invention claimed is:

1. An all electric mining vehicle, comprising:

a frame, a set of wheels and a scoop;

a power system including an electric motor, the electric motor having a peak power value;

the power system further including an electric power source for powering the electric motor, the electric power source being carried by the vehicle, wherein the electric power source is capable of being exchanged;

the mining vehicle having an overall length, an overall width and an overall height;

the mining vehicle having an envelope volume equal to a product of the overall length, the overall width and the overall height;

the mining vehicle having a power density equal to a ratio of the peak power value to the envelope volume; and wherein the power density is approximately 6 kilowatts per cubic-meter or greater.

2. The mining vehicle according to claim 1, wherein the electric power source is a battery.

3. The mining vehicle according to claim 2, wherein the battery has an electric voltage of at least 500 volts.

4. The mining vehicle according to claim 1, wherein the mining vehicle has a hauling capacity, the hauling capacity being a weight of material that can be loaded into the scoop and transported by the mining vehicle, wherein the hauling capacity is approximately 1 metric ton or greater.

5. The mining vehicle according to claim 1, wherein the hauling capacity is approximately 3 metric tons or greater.

6. The mining vehicle according to claim 1, wherein the hauling capacity is approximately 4 metric tons or greater.

7. The mining vehicle according to claim 1, wherein:

the mining vehicle having a first end and a second end, wherein the first end is associated with the scoop;

the mining vehicle having a first end ground visibility distance associated with the first end of the mining vehicle; and wherein the first end ground visibility distance is substantially less than 15 meters.

8. The mining vehicle according to claim 7, wherein:

the mining vehicle having a second end ground visibility distance associated with the second end;

wherein the second end ground visibility distance is substantially less than 30 meters.

9. An all electric mining vehicle, comprising:

a frame, a set of wheels and a scoop;

a power system including an electric motor;

the power system further including an electric power source for powering the electric motor, the electric power source being carried by the vehicle, wherein the electric power source is capable of being exchanged;

the mining vehicle having an overall length;

wherein the mining vehicle has a hauling capacity, the hauling capacity being a weight of material that can be loaded into the scoop and transported by the mining vehicle;

wherein a ratio of the hauling capacity to the overall length is greater than 0.6 metric tons per meter.

10. The mining vehicle according to claim 9, wherein the electric power source is a battery.

11. The mining vehicle according to claim 9, wherein the hauling capacity has a value approximately in a range between 1 metric ton and 3 metric tons.

12. The mining vehicle according to claim 9, wherein the hauling capacity has a value approximately in a range between 1 metric ton and 4 metric tons.

13. An all electric mining vehicle, comprising:

a frame, a set of wheels, and a scoop;

a power system including an electric motor;

the power system further including an electric power source for powering the electric motor, the electric power source being carried by the vehicle, wherein the electric power source is capable of being exchanged;

the mining vehicle having an overall length;

the mining vehicle has a hauling capacity, the hauling capacity being a weight of material that can be loaded into the scoop and transported by the mining vehicle;

wherein the overall length is substantially less than six meters and wherein the hauling capacity is at least three metric tons.

14. The mining vehicle according to claim 13, wherein the electric motor has a peak power value of at least 100 kilowatts.

15. The mining vehicle according to claim 13, wherein the electric power source is a battery.

16. The mining vehicle according to claim 13, wherein the hauling capacity is approximately four metric tons.

17. The mining vehicle according to claim 13, wherein:

the mining vehicle having a first end and a second end, wherein the first end is associated with the scoop;

the mining vehicle having a first end ground visibility distance associated with the first end of the mining vehicle; and wherein the first end ground visibility distance is substantially less than 15 meters.

18. The mining vehicle according to claim 17, wherein:

the mining vehicle having a second end ground visibility distance associated with the second end;

wherein the second end ground visibility distance is substantially less than 30 meters.

19. The mining vehicle according to claim 13, wherein a ratio of the hauling capacity to the overall length is greater than 0.6 metric tons per meter.

* * * * *